US012553243B2

(12) United States Patent
Sager

(10) Patent No.: US 12,553,243 B2
(45) Date of Patent: Feb. 17, 2026

(54) FILTRATION DEVICE WITH STEP

(71) Applicant: Karen M. Sager, Ridgewood, NJ (US)

(72) Inventor: Karen M. Sager, Ridgewood, NJ (US)

( * ) Notice: Subject to any disclaimer, the term of this patent is extended or adjusted under 35 U.S.C. 154(b) by 0 days.

(21) Appl. No.: 17/874,852

(22) Filed: Jul. 27, 2022

(65) Prior Publication Data

US 2024/0035282 A1 Feb. 1, 2024

(51) Int. Cl.
*E04D 13/076* (2006.01)

(52) U.S. Cl.
CPC ..... *E04D 13/076* (2013.01)

(58) Field of Classification Search
CPC ..... E04D 13/076; E04D 13/068
USPC ..... 52/12
See application file for complete search history.

(56) References Cited

U.S. PATENT DOCUMENTS

| | | | | |
|---|---|---|---|---|
| 116,072 | A | 6/1871 | Lockwood | |
| 2,810,173 | A * | 10/1957 | Bearden | E04D 13/076 248/48.1 |
| 2,997,763 | A * | 8/1961 | Serfass | E04D 13/076 24/546 |
| 3,057,481 | A | 10/1962 | Pall | |
| 3,428,183 | A | 2/1969 | Bristow | |
| 3,665,663 | A | 5/1972 | Scherer | |
| 3,696,373 | A | 10/1972 | Dunn et al. | |
| 3,741,398 | A * | 6/1973 | Abramson | E04D 13/076 210/474 |
| 4,146,293 | A | 3/1979 | Mutton et al. | |
| 4,232,310 | A | 11/1980 | Wilson | |
| 4,333,208 | A | 6/1982 | Fuller | |
| 4,418,504 | A | 12/1983 | Lassiter | |
| 4,586,030 | A | 4/1986 | Klosterman | |
| 4,676,485 | A | 6/1987 | Ciordinik et al. | |
| 4,695,359 | A | 9/1987 | Woodard, Jr. et al. | |
| 4,765,101 | A | 8/1988 | Wolf | |
| 4,814,750 | A | 3/1989 | Abramson | |
| 4,841,686 | A | 6/1989 | Rees | |
| 4,907,381 | A | 3/1990 | Ealer | |
| 5,038,530 | A | 8/1991 | Watkins | |
| 5,049,855 | A | 9/1991 | Slemon et al. | |

(Continued)

FOREIGN PATENT DOCUMENTS

| | | | | |
|---|---|---|---|---|
| CA | 2723499 A1 * | 3/2011 | ..... | E04D 13/076 |
| CA | 2807962 A1 | 2/2012 | | |

(Continued)

*Primary Examiner* — Babajide A Demuren
(74) *Attorney, Agent, or Firm* — MH2 TECHNOLOGY LAW GROUP LLP; Stuart I. Smith

(57) ABSTRACT

A gutter guard for filtering water that enters a rain gutter on a building includes: a screen body configured to be positioned above a lowest portion of the rain gutter and having a plurality of openings that are penetrable by water. The screen body has a first surface, a second surface, and a channel positioned between the first surface and the second surface. The channel has a first wall adjacent to and extending in a first direction from the first surface, the first wall having a height in the first direction, a second wall adjacent to and extending in the first direction from the second surface, the second wall having a height in the first direction, and a joining section that joins the first wall to the second wall. The height of the first wall and the height of the second wall are different.

26 Claims, 29 Drawing Sheets

(56) References Cited

U.S. PATENT DOCUMENTS 5,072,551 A * 12/1991 Manoogian, Jr. ..... E04D 13/076 52/12
5,526,612 A 6/1996 Wade
5,557,891 A 9/1996 Albracht
5,568,706 A 10/1996 Gerhing et al.
5,592,149 A 1/1997 Alizi
5,592,783 A 1/1997 Jones
5,595,027 A 1/1997 Vail
5,619,825 A 4/1997 Leroney et al.
5,677,674 A 10/1997 Wolf
5,729,931 A 3/1998 Wade
5,795,835 A 8/1998 Bruner et al.
6,161,338 A * 12/2000 Kuhns ..... E04D 13/076 52/12
6,215,397 B1 4/2001 Lindskog
6,412,229 B2 7/2002 Kuhns
6,514,324 B1 2/2003 Chapman
6,598,352 B2 7/2003 Higginbotham
6,951,077 B1 10/2005 Higginbotham
7,112,274 B1 9/2006 Sanguinetti
7,174,688 B2 2/2007 Higginbotham
7,191,564 B2 3/2007 Higginbotham
7,352,284 B2 4/2008 Krill
7,455,766 B1 11/2008 Lewis
7,584,577 B2 9/2009 Esmond et al.
7,765,743 B2 8/2010 Guilford
7,913,458 B2 3/2011 Higginbotham
7,919,002 B1 4/2011 Hurtado
7,946,081 B1 5/2011 Frederick
7,956,278 B1 6/2011 Popovich
7,987,634 B2 8/2011 Bailey et al.
8,006,438 B2 8/2011 Higginbotham
RE42,896 E 11/2011 Higginbotham
RE43,555 E 7/2012 Higginbotham
8,312,677 B2 11/2012 Higginbotham
8,397,436 B2 3/2013 Higginbotham
8,475,657 B2 7/2013 Wu
8,595,985 B1 12/2013 Feldhaus
8,720,123 B1 5/2014 Katiraei
9,010,029 B2 4/2015 Higginbotham
9,115,497 B2 8/2015 Morris et al.
9,127,463 B1 9/2015 Feldhaus
9,163,406 B1 * 10/2015 Ealer, Sr. ..... E04D 13/0767
9,183,714 B2 11/2015 Piper, Sr. et al.
9,422,722 B2 8/2016 Iannelli
9,650,788 B1 * 5/2017 Ealer, Sr. ..... E04D 13/076
9,915,070 B2 3/2018 Lenney
2002/0152691 A1 10/2002 Wade
2003/0046876 A1 3/2003 Higginbotham
2004/0031222 A1 2/2004 Porat
2004/0214495 A1 10/2004 Foss et al.
2004/0232057 A1 11/2004 Orozco et al.
2004/0255522 A1 12/2004 Knudson et al.
2005/0102909 A1 5/2005 Carpenter et al.
2005/0235577 A1 10/2005 Smith
2005/0246967 A1 11/2005 Esmond et al.
2005/0257432 A1 11/2005 Higginbotham
2006/0053697 A1 3/2006 Higginbotham
2006/0179723 A1 * 8/2006 Robins ..... E04D 13/076 52/11
2006/0248805 A1 11/2006 Gentry
2006/0278573 A1 12/2006 Robinson
2007/0045176 A1 3/2007 Chandra et al.
2007/0055007 A1 3/2007 Pagel et al.
2007/0068092 A1 3/2007 Fraser, Jr.
2007/0199249 A1 * 8/2007 Beck ..... E04D 13/076 52/12
2007/0214731 A1 * 9/2007 Bachman ..... E04D 13/076 52/12
2007/0234647 A1 10/2007 Higginbotham
2007/0243781 A1 10/2007 Chou
2008/0286163 A1 11/2008 Garfield et al.
2008/0302713 A1 12/2008 Patrick
2009/0000210 A1 1/2009 Barnett
2009/0236273 A1 9/2009 Esmond et al.
2009/0288349 A1 11/2009 Wootton
2010/0095492 A1 4/2010 Boone
2010/0251626 A1 10/2010 Roque Alonso
2011/0041414 A1 * 2/2011 Bell ..... E04D 13/0725 52/12
2011/0185641 A1 * 8/2011 Snell ..... E04D 13/076 52/12
2011/0252723 A1 10/2011 Devery
2011/0308557 A1 12/2011 Kaiser
2012/0132759 A1 5/2012 Sager
2012/0297696 A1 * 11/2012 Albracht ..... E04D 13/0765 52/11
2013/0097943 A1 4/2013 Higginbotham
2013/0145699 A1 6/2013 Olthoff
2013/0160377 A1 6/2013 Sager
2014/0202086 A1 * 7/2014 Reese ..... E04D 13/076 52/12
2015/0040488 A1 2/2015 Lenney
2015/0143756 A1 5/2015 Higginbotham
2015/0218827 A1 8/2015 Alleger
2015/0225959 A1 8/2015 Lenney
2015/0330085 A1 11/2015 Iannelli
2017/0037632 A1 * 2/2017 Lenney ..... E04D 13/076
2017/0145697 A1 5/2017 Anthony
2017/0152661 A1 6/2017 White
2017/0342716 A1 11/2017 Sinclair
2018/0087279 A1 * 3/2018 Lenney ..... E04D 13/0404
2018/0179761 A1 6/2018 Higginbotham
2019/0063070 A1 2/2019 Cullen
2019/0153730 A1 5/2019 Sager
2019/0224937 A1 7/2019 Fanelli et al.
2019/0277032 A1 9/2019 Gori
2019/0352912 A1 11/2019 Sager
2021/0102379 A1 * 4/2021 Moran ..... E04D 13/076
2021/0154610 A1 5/2021 Carredo
2022/0081909 A1 * 3/2022 Brochu ..... E04D 13/0767

FOREIGN PATENT DOCUMENTS

CN 101954224 A 1/2011
CN 102458606 A 5/2012
CN 107213789 A 9/2017
DE 10332747 B3 11/2004
DE 102004043349 A1 3/2006
FR 1319204 A 2/1963
KR 20210144604 A 11/2021
WO 8903465 A1 4/1989

* cited by examiner

FILTRATION DEVICE WITH STEP

FIELD

The present invention relates generally to filtration devices, including meshes and other water-permeable surfaces. More specifically, particular embodiments of the invention relate to filtration devices having a step or channel.

BACKGROUND

Many homes and other buildings have gutters that collect rain water and divert the collected rain water downward to the ground or other surfaces. Leaves and other debris can accumulate in the gutters either from being directly deposited into the gutters or from being washed off of, or otherwise moved from, the roof of the building to the gutter.

A problem exists in that the above-mentioned debris can accumulate to the point of blocking the gutter and causing the water to overflow an edge of the gutter instead of flow through the gutter as designed. Various devices have been created in an attempt to prevent the clogging of gutters. Most of these devices do not prevent clogging in a satisfactory manner.

Accordingly, improved systems and methods for preventing the clogging of gutters are needed.

SUMMARY

Embodiments of the invention address the above-described problem of gutter clogging by providing a filtration device that includes, for example, a mesh having a channel therein where the channel has walls of different heights.

Embodiments of the invention address the problem of filtration devices having liquid flow too quickly over a surface of the filtration device to go through the filtration device, by providing a filtration device that includes, for example, a mesh having a channel therein where the channel has walls of different heights.

Embodiments of the invention include a filtration system having a screen (which can be a stand-alone screen or a screen that is part of a porous underlying structure) that filters out debris (e.g., leaves, pine needles, oak tassels) while allowing water to pass through. In embodiments, a portion of the screen (a stand-alone screen or a screen that is part of a porous underlying structure) is formed to provide one or more channels framed by walls of unequal heights. In certain situations, channels framed by walls of equal heights can fill with water during heavy rainfall, creating a pool within the channel over which water will continue to flow along the top of the screen rather than drop downward through the screen's openings into, for example, an underlying rain gutter. Pools of water can form within a channel due to the volume of water filling the channel being greater than the amount of water able to drop downward through the screen. Making the downstream wall (the wall of the channel that is on the downstream side of the channel) that frames a channel be of a height that is greater than its opposite wall (the rear, or upstream, wall) stops the forward flow of water over the top of a pool of water existing in the channel by creating a porous dam (a portion of the downstream wall) against which forward flowing water will slow. Water will rise slightly against the higher downstream wall, then begin to drop downward through the channel's bottom rather than flow forward across the top of the pool of water within the channel and continue its forward flow across the top surface of the remainder of the filtering system's screen. In screens with channel walls of the same height (a flat top screen), the rear facing wall of the channel is relied upon as a primary way to get water to drop through the screen. Whereas with a channel having walls of different heights, the downstream side of the channel is a secondary path for water to drop through the screen, thereby making the whole channel feature more effective.

In embodiments, making the rear wall that frames a channel be of a greater height than its opposite (front, or downstream) wall creates a vertical flowing volume of water that presses on the rear (upstream) top surface of the pool of water existing in a channel, causing the pooled water to drop downward through the screen at that area of downward water pressure rather than travel across the top of the pool and continue its forward (downstream) water flow. Channel walls of unequal height result in each channel wall acting independently to pull more water through the screen.

In one aspect, a gutter guard for filtering water that enters a rain gutter on a building includes a screen body configured to be positioned above a lowest portion of the rain gutter and having a plurality of openings that are penetrable by water. The screen body has a first surface, a second surface, and a channel positioned between the first surface and the second surface. The channel has a first wall adjacent to and extending in a first direction from the first surface, the first wall having a height in the first direction, a second wall adjacent to and extending in the first direction from the second surface, the second wall having a height in the first direction, and a joining section that joins the first wall to the second wall. The height of the first wall and the height of the second wall are different.

In another aspect, a filtration screen for filtering a liquid that flows over the filtration screen from an upstream position to a downstream position includes a screen body having a plurality of openings that are penetrable by the liquid. The screen body has a first surface, a second surface, and a channel positioned between the first surface and the second surface. The channel has a first wall adjacent to and extending in a first direction from the first surface, the first wall having a height in the first direction, a second wall adjacent to and extending in the first direction from the second surface, the second wall having a height in the first direction, and a joining section that joins the first wall to the second wall. The height of the first wall and the height of the second wall are different.

In another aspect, a filtration screen for filtering a liquid that flows over the filtration screen from an upstream position to a downstream position includes a screen body having a plurality of openings that are penetrable by the liquid. The screen body has a first surface; a second surface; a first channel having a first wall having a height, a second wall a height, and a joining section that joins the first wall to the second wall; a second channel having a third wall, a fourth wall, and a joining section that joins the third wall to the fourth wall, and a channel joining section that joins the second wall to the third wall, the channel joining section being one of U-shaped and V-shaped. The first wall adjoins the first surface, the second wall adjoins the channel joining section, the third wall adjoins the channel joining section, the fourth wall adjoins the second surface, and the height of the first wall and the height of the second wall are different.

In another aspect, a gutter guard for filtering water that enters a rain gutter on a building. The gutter guard includes a screen body configured to be positioned above a lowest portion of the rain gutter and having a plurality of openings that are penetrable by water. The screen body has a first surface; a second surface; and a step positioned between the first surface and the second surface, the step having a wall extending in a first direction from the first surface to the second surface, the first wall having a height in the first direction. The first surface and the second surface are non-coplanar.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
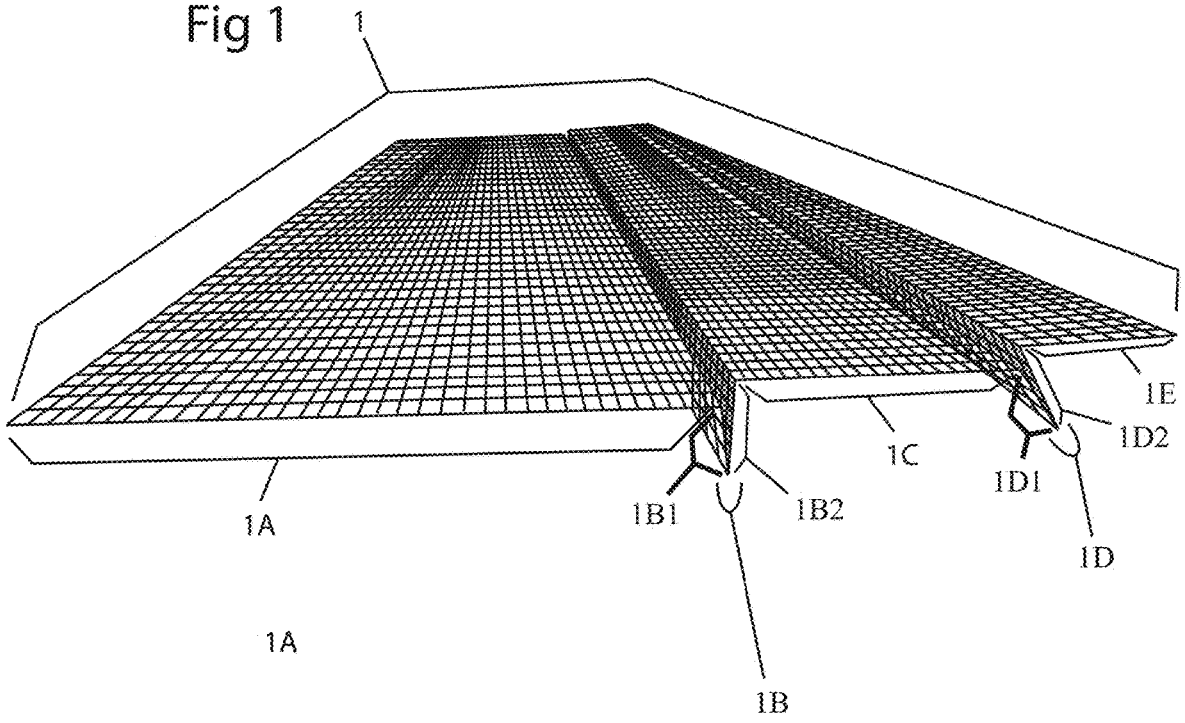
FIG. 1 is a perspective view of an exemplary filtration device in accordance with embodiments of the invention.

All drawings are schematic and not necessarily to scale. Parts given a reference numerical designation in one figure may be considered to be the same parts where they appear in other figures without a numerical designation for brevity unless specifically labeled with a different part number and described herein.

1.

DETAILED DESCRIPTION

The following description of the preferred embodiment(s) is merely exemplary in nature and is in no way intended to limit the invention, its application, or uses.

Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled in a solid or non-solid state.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the example of a gutter guard to prevent clogging of a rain gutter is used to describe embodiments of the invention, it is noted that the invention also applies to other filtering applications such as, for example, filtering drinkable or industrial liquids, and filtering any liquid.

As stated above, a problem exists in that debris can accumulate to the point of blocking the gutter and causing the water to overflow an edge of the gutter instead of flow through the gutter as designed. This debris can include, for non-limiting example, leaves, parts of leaves, seeds, seed pods, other tree material, moss, spores and other products from organisms growing on roofs, material from decaying roof shingles, etc. A mesh screen can be used to block debris from entering the gutter. Some embodiments of the invention, examples of which are described in more detail below, provide one or more wires or threads of a metal or other material that is a different material from the material of the screen. In embodiments, this wire or thread acts as a growth inhibiting material to prevent growth on the screen.

This description describes several exemplary embodiments of the invention. Some of these embodiments include copper wire, or copper element(s) having a variety of shapes. One or more of certain properties of copper, namely, for example, the ability to prevent or kill moss, mold, mildew, algae, lichen, microbes, bacteria, viruses, germs, and/or the ability to detoxify toxic elements and/or render harmless harmful radiations, are advantageously used in embodiments of the invention. An example of such a material is bacteria killing ceramics. For simplicity and clarity, it is understood that when the term "copper" is used in this disclosure, other metals and other materials having properties or made to have properties able to prevent or kill moss, mold, mildew, algae, lichen, microbes, bacteria, viruses, germs, and/or the ability to detoxify toxic elements and/or render harmless harmful radiations can also be used. In addition to the term "copper", the terms "growth inhibiting wire", "growth inhibiting thread", "growth inhibiting element", or "growth inhibiting material" is used in this disclosure to represent copper and/or any other material that inhibits growth and/or has one or more of the exemplary properties listed above.

In this disclosure, the term "wire" is understood to also include thread or other elongated structures; the term "ribbon" is understood to mean any material with more length than width and capable of flexing; the term "screen" is understood to also include any structure, barrier, cloth, material or method able to prevent the passing of at least one element while allowing one or more other elements to pass through the body of the screen; also included in the invention is any structure, material or method able to change the property of any liquid, gas, moss, mold, mildew, algae, lichen, microbes, bacteria, poison, toxin, radiation, virus or germ that passes through it; and the term "shape" is understood to also include graphical representations of words, letters, phrases, logos, lines, numbers, etc.

FIG. 1 shows an exemplary gutter screen 1 in accordance with embodiments of the disclosure. In the example shown in FIG. 1, a gutter screen 1 includes a screen body that has a plurality of passages between members of the screen body. The passages allow water or other liquids to pass through the screen body. In the example shown in FIG. 1, the screen body is a mesh formed of interwoven members that extend perpendicular to each other. In other embodiments, the screen body is an expanded metal material and the passages are openings in the expanded metal material. Other embodiments include a screen body made of any material that permits the passage of water or other liquid, while preventing debris from passing through the screen body. In embodiments, the screen body shown in FIG. 1 is a single layer structure. Other embodiments include one or more additional layers of filter material that can be the same, finer, or less fine. The one or more additional layers can be positioned above or below the layer shown.

The example in FIG. 1 has a screen body having multiple levels and including downward extending channels 1B, 1D present within the screen body of gutter screen 1. Channel 1B has a front wall 1B2 that is higher than channel 1B's rear wall 1B1, with front wall 1B2 bending and extending into a plane that is higher than the plane that leads into channel 1B's rear wall 1B1 Channel 1D has a front wall 1D2 that is higher than channel 1D's rear wall 1D1, with front wall 1D2 bending and extending into a plane that is higher than the plane that leads into channel 1D's rear wall 1D1. This configuration forms a gutter screen having planes that are higher or lower than preceding or succeeding planes. There are several methods for shaping screen material of the screen body into gutter screen 1 shown in FIG. 1 or into alternate embodiments of the gutter guard shown in FIG. 1. One such method is to roll form gutter screen 1 through a series of rollers that progressively bend the screen material as desired and another method is to stamp a section of flat piece of the screen material (the industry term is a "blank") into the desired shape.

Referring to FIG. 1 in greater detail, gutter screen 1 is shown having its rear plane 1A extending forward for a distance and then bending downward at its front edge into a V-shaped channel 1B with channel 1B being formed by rear wall 1B1 that bends upward from its bottom edge into front wall 1B2, with front wall 1B2 extending higher than channel 1B's rear wall 1B1. The top edge of front wall 1B2 bends and extends forward forming a plane 1C which extends a distance then bends at its front edge downward into a second V-shaped channel 1D. V-shaped channel 1D is formed by rear wall 1D1 that bends upward from its bottom edge into front wall 1D2 with front wall 1D2 extending higher than channel 1D's rear wall 1D1. The top edge of front wall 1D2 bends and extends forward with the extension forming a plane 1E. In embodiments, rear wall 1B1 and front wall 1B2 are in contact with each other for at least a portion of the length of the shorter of rear wall 1B1 and front wall 1B2. In embodiments, rear wall 1B1 and front wall 1B2 are in contact with each other for the entire length of the shorter of rear wall 1B1 and front wall 1B2. In embodiments, rear wall 1B1 and front wall 1B2 are in close proximity to each other for a portion of, or the entire length of, the shorter of rear wall 1B1 and front wall 1B2.

Figure 12:
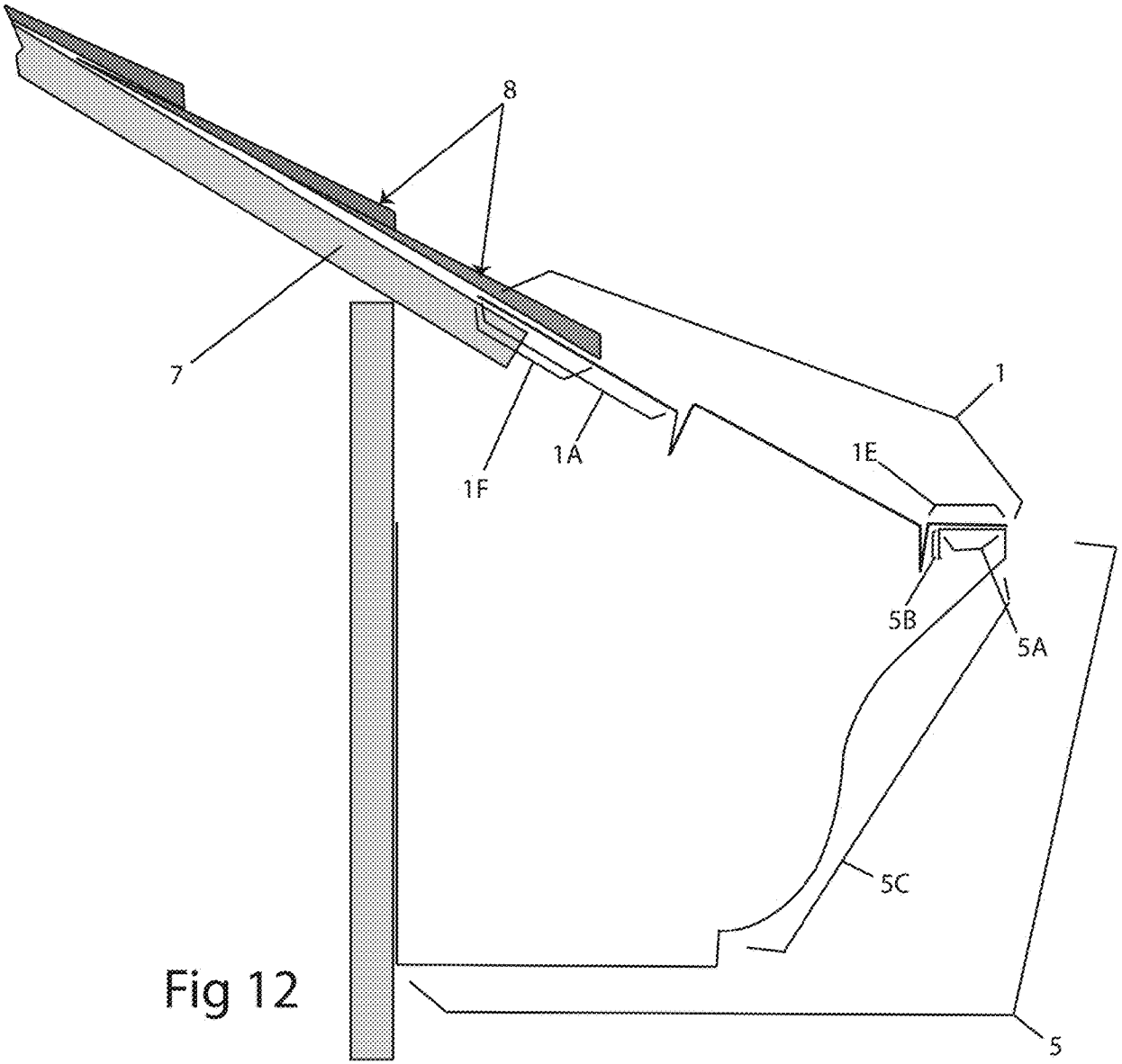
FIG. 12 is an end view of an exemplary embodiment of the invention including the filtration device of FIG. 1 installed on a rain gutter.
Figure 19:
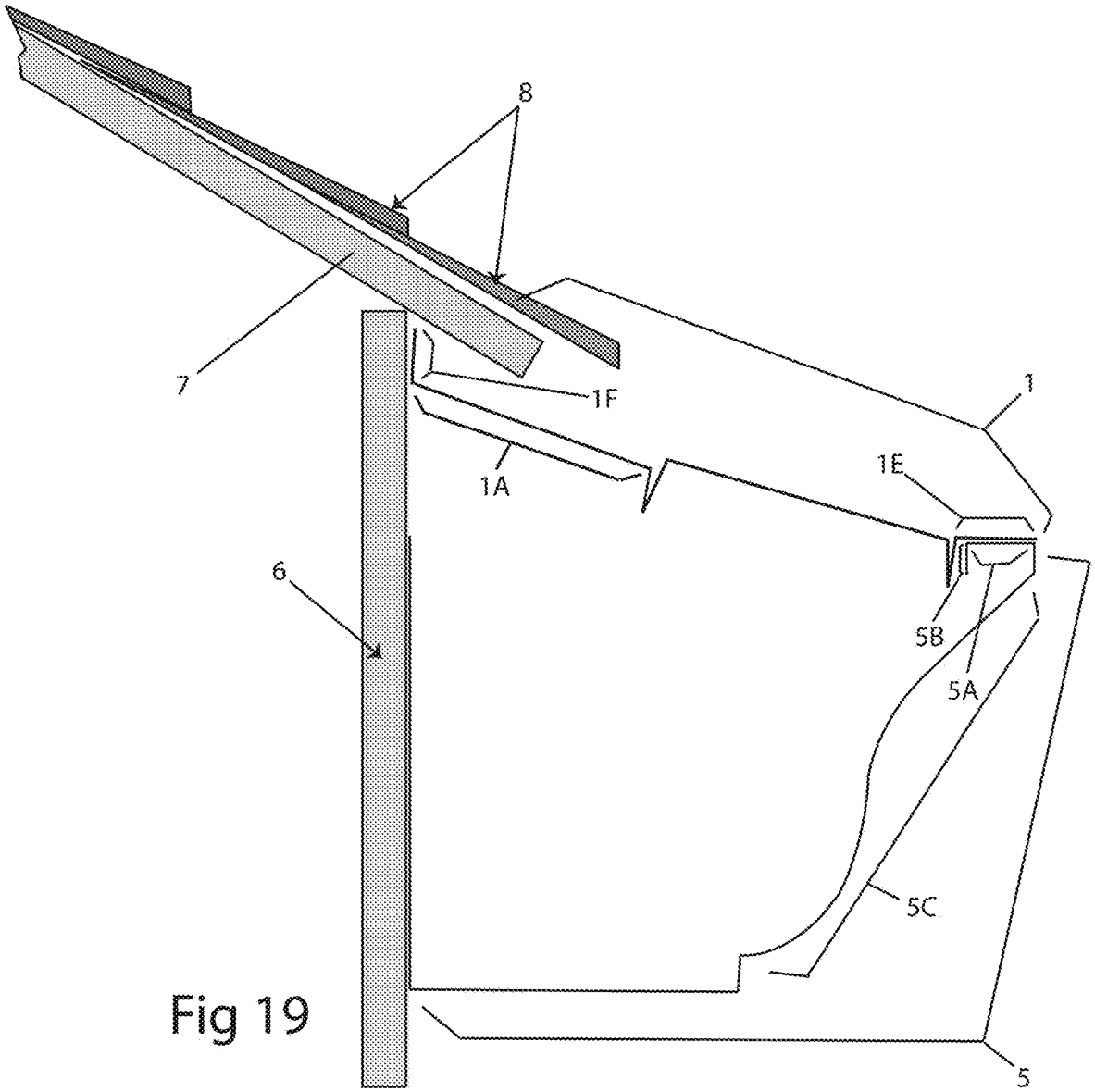
FIG. 19 is an end view of an exemplary embodiment of the invention including a filtration device installed on a rain gutter.
Figure 20:
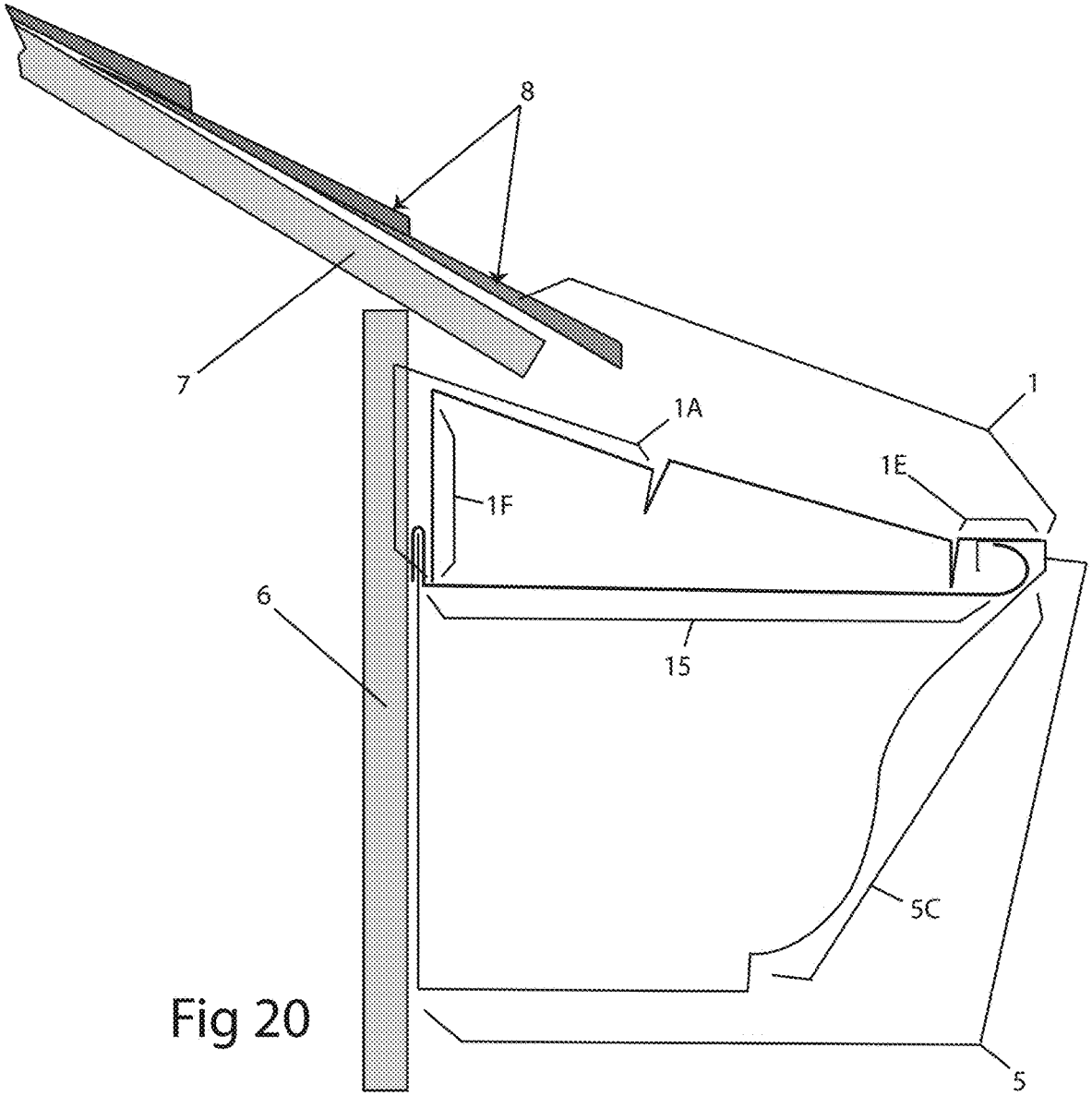
FIG. 20 is an end view of an exemplary embodiment of the invention including a filtration device installed on a rain gutter.

Referring to FIG. 12, gutter screen 1 is shown having a rear portion 1F of plane 1A inserted beneath a roof's shingles 8 and plane 1E resting atop a top plane 5A of a gutter lip serving to secure the gutter screen in place atop an underlying rain gutter 5. FIGS. 19 and 20 show, respectively, that gutter screen 1 may alternatively have rear portion 1F of plane 1A bent upward to rest against a building's facia board 6 (FIG. 19) or bent downward to rest on a gutter hanger 15 (FIG. 20).

Figure 2:
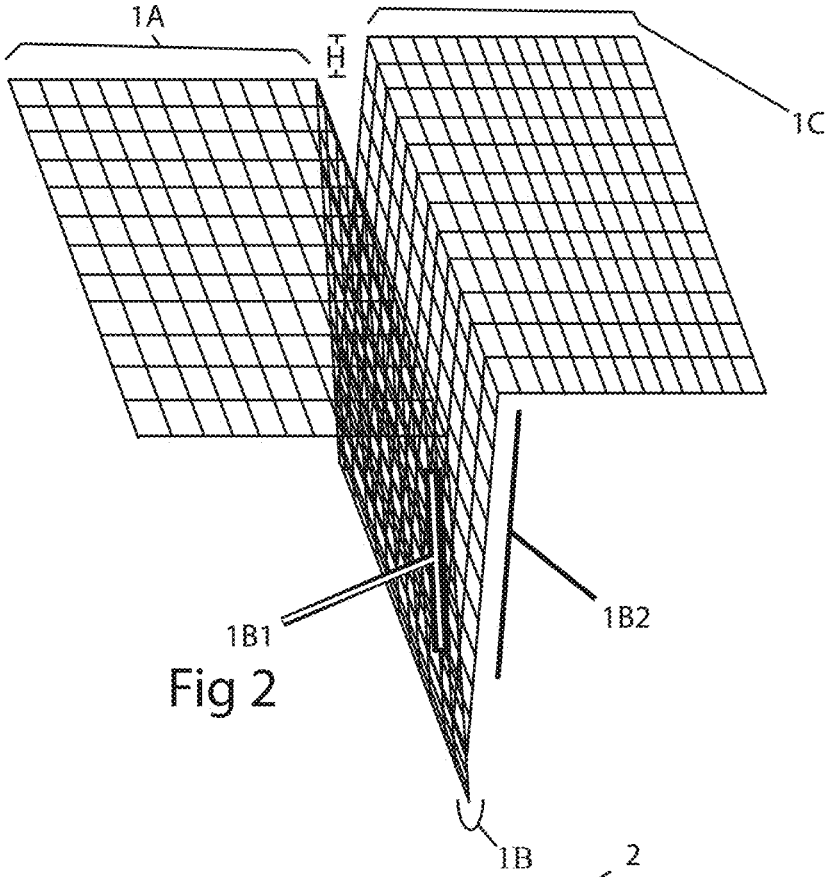
FIG. 2 is a magnified view of a portion of the filtration device of FIG. 1.
Figure 3:
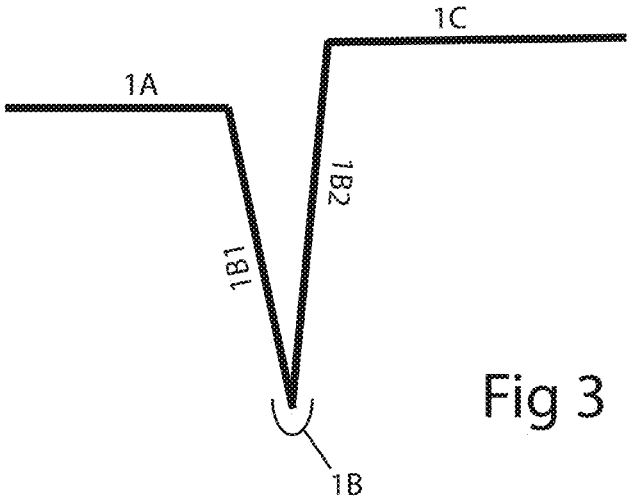
FIG. 3 is a schematic end view of the filtration device of FIG. 1.
Figure 3A:
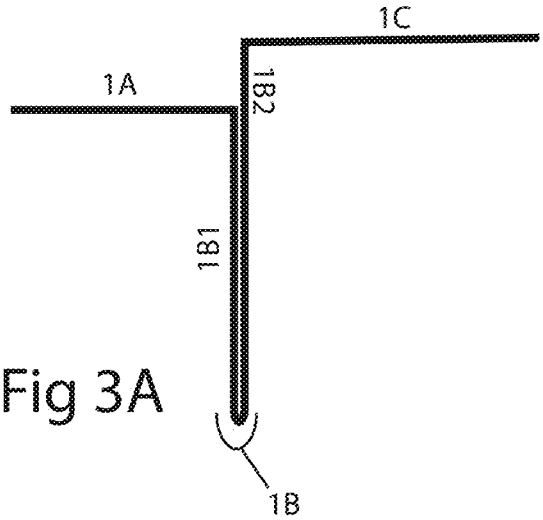
FIG. 3A is a schematic end view of an alternate embodiment of the filtration device of FIG. 1.
Figure 3B:
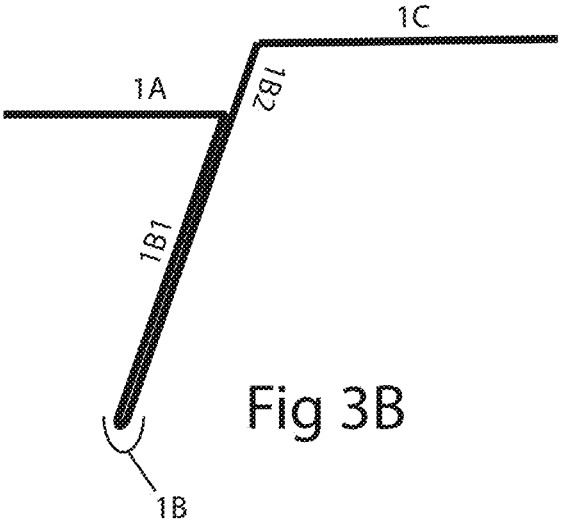
FIG. 3B is a schematic end view of an alternate embodiment of the filtration device of FIG. 1.
Figure 3C:
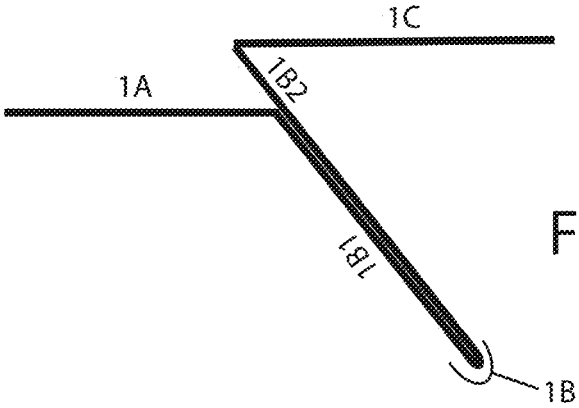
FIG. 3C is a schematic end view of an alternate embodiment of the filtration device of FIG. 1.

FIG. 2 shows that front wall 1B2 of channel 1B rises to a height H greater than channel 1B's rear wall 1B1, causing gutter screen 1's plane 1C to be higher than the gutter screen 1's plane 1A. FIG. 3 is a profile view of the gutter screen 1 in FIG. 2 showing that front wall 1B2 of channel 1B rises above channel 1B's rear wall 1B1. FIG. 3A is a profile view of an embodiment where the gutter screen 1 includes front wall 1B2 of channel 1B rising above channel 1B's rear wall 1B1 and front wall 1B2 contacting rear wall 1B1 for the entire height of rear wall 1B1. FIG. 3B is a profile view of an embodiment where the gutter screen 1 includes front wall 1B2 of channel 1B rising above channel 1B's rear wall 1B1, front wall 1B2 contacting rear wall 1B1 for the entire height of rear wall 1B1, and front wall 1B2 and rear wall 1B1 being angled relative to planes 1A and 1C. FIG. 3C is a profile view of another embodiment where the gutter screen 1 includes front wall 1B2 of channel 1B rising above channel 1B's rear wall 1B1, front wall 1B2 contacting rear wall 1B1 for the entire height of rear wall 1B1, and front wall 1B2 and rear wall 1B1 being angled relative to planes 1A and 1C.

In embodiments, downward extending channels are V-shaped, as shown in FIG. 2. In other embodiments, downward extending channels may be of other shapes such as, but not limited to, the U-shaped channel shown in FIG. 4. In embodiments, regardless of channel shape and regardless of the number of walls a channel may be comprised of, the channel's first wall (its rear wall) will be either higher or lower than the channel's last wall (its front or forward-most wall). Downward extending channels having first and last walls have top edges that are level with each other may be employed in embodiments.

Figure 4:
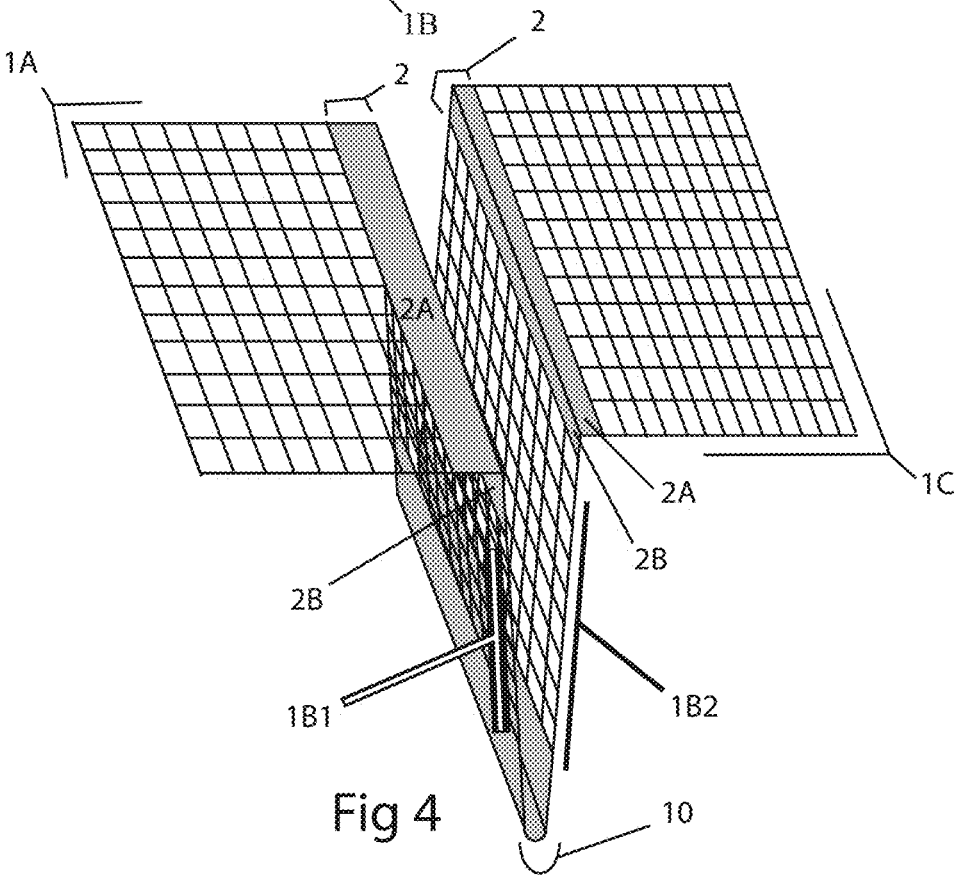
FIG. 4 is a partial view of an exemplary embodiment of the invention.
Figure 5:
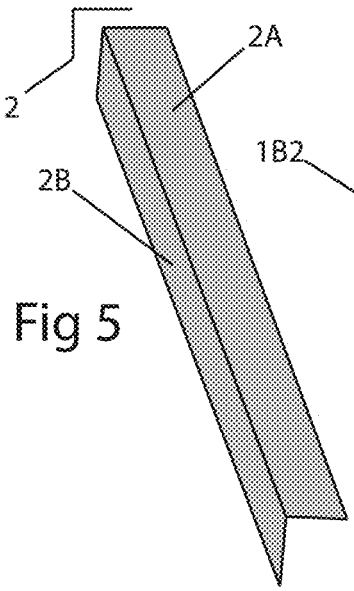
FIG. 5 is a perspective view of an angle in accordance with embodiments of the invention.
Figure 6:
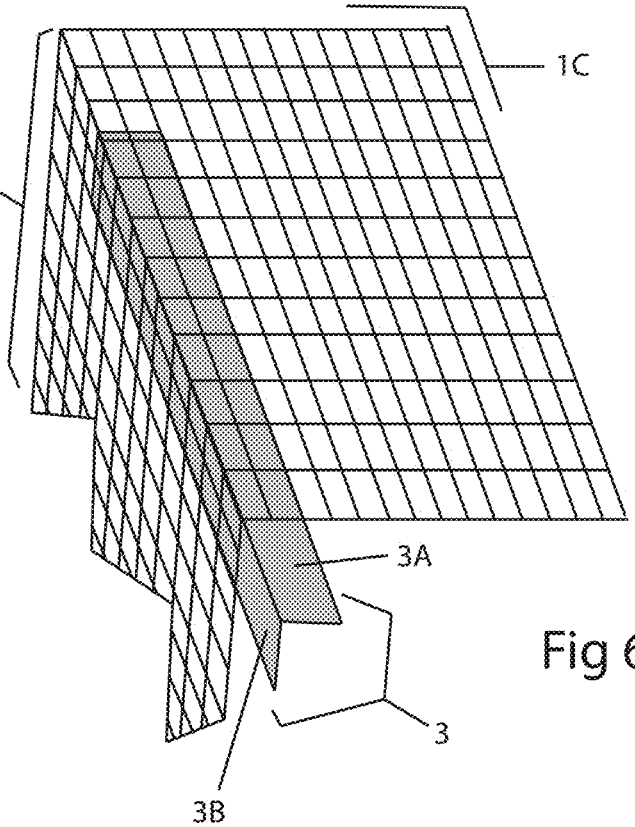
FIG. 6 is a perspective view of an embodiment of the invention incorporating the angle of FIG. 5.
Figure 7:
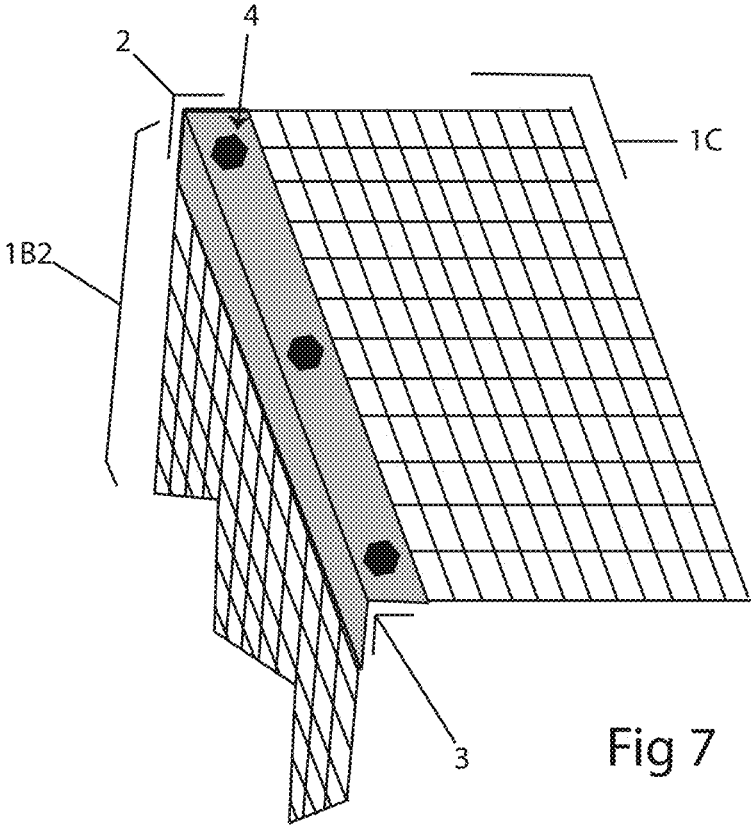
FIG. 7 is a perspective view of an embodiment of the invention incorporating the angle of FIG. 5.

Referring to FIG. 4, solid material angled reinforcement bars 2, (hereafter referred to as angled reinforcement bars), are shown affixed to the top edges of gutter screen 1's downward extending channel 1B. The FIG. 4 embodiment shows, as does the FIG. 2 embodiment, the front wall 1B2 of channel 1B rising to a greater height than channel 1B's rear channel wall 1B1. Also shown in FIG. 4 is a solid-material U-shaped band 10 affixed to either the inside or the outside of a bottom U-shaped portion of channel 1B. FIG. 5 shows angled reinforcement bar 2 having a top plane 2A whose length and width are equal to, or approximately equal to, an adjacent and downwardly extending plane 2B. In other embodiments, angled reinforcement bar 2 has top plane 2A and downwardly extending plane 2B that have lengths that are not equal to one another and/or widths that are not equal to one another. FIG. 6 shows an angled reinforcement bar 3 placed beneath the bend that occurs at the top edge of front wall 1B2 and plane 1C. FIG. 7 shows angled reinforcement bar 2 atop a bend present in gutter screen 1 which occurs at the top edge of front wall 1B2 with the angled reinforcement bar 2 being crimped 4 to underlying angled reinforcement bar 3. As a result, FIG. 7 shows angled reinforcement bar 3 being located immediately beneath the screen bend, which, in turn, is located immediately beneath angled reinforcement bar 2.

Figure 8:
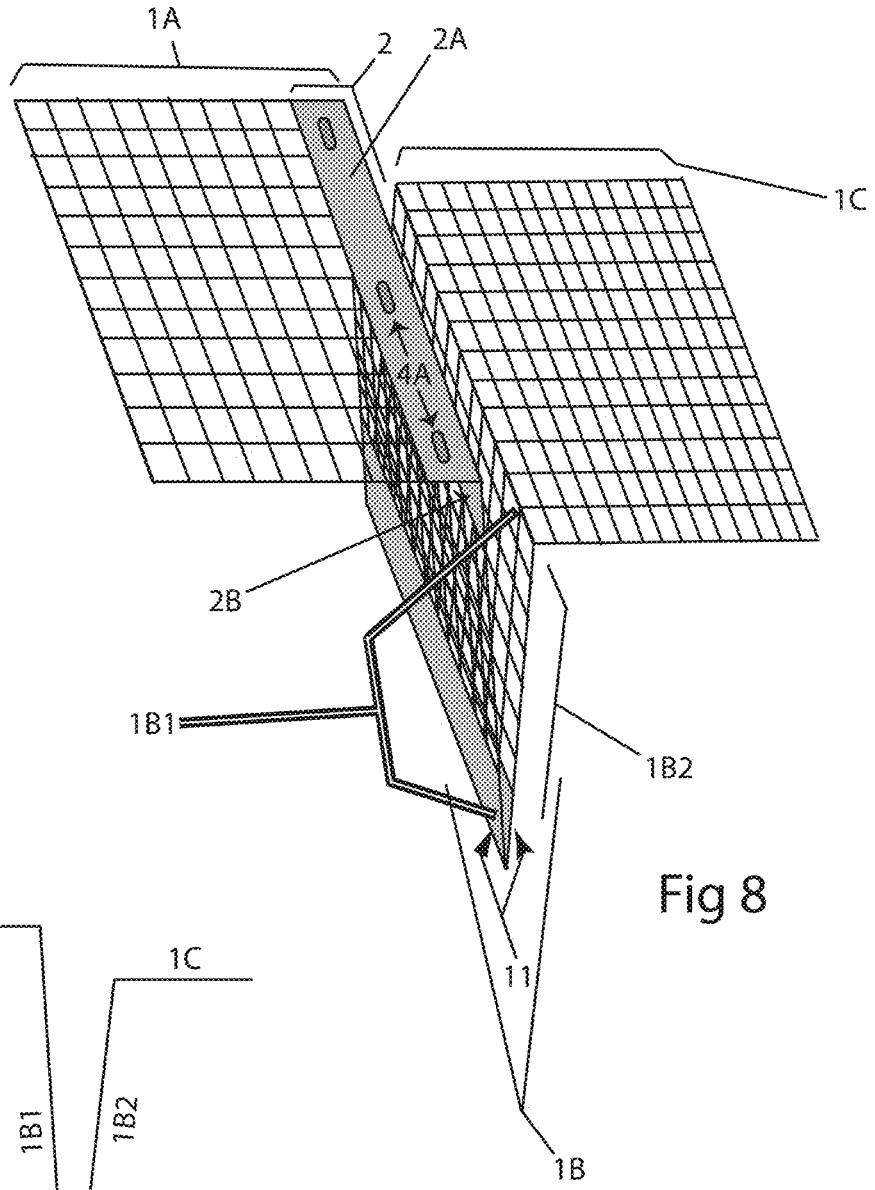
FIG. 8 is a perspective view of an exemplary filtration device in accordance with embodiments of the invention.
Figure 8A:
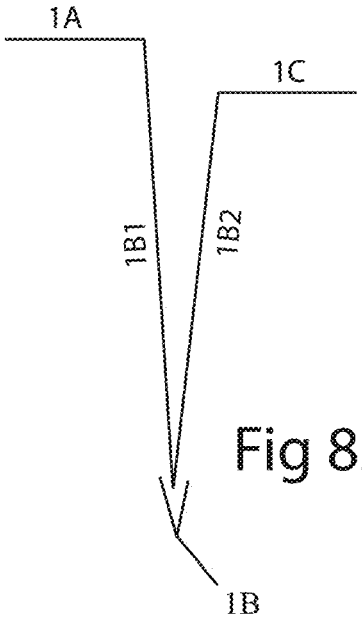
FIG. 8A is a schematic end view of the filtration device of FIG. 8.

FIG. 8 shows an embodiment in which channel 1B is V-shaped and has its rear wall 1B1 rising to a height greater than its front wall 1B2. FIG. 8 also shows an angled reinforcement bar 2 has been crimped through its top plane 2A with oblong crimp indentations 4A. It is noted that any appropriate shape crimp may be used when fastening elements of the invention together. Also shown in FIG. 8 is a solid-material V-shaped band 11 affixed to either the inside or the outside of a bottom V-shaped portion of channel 1B. FIG. 8A is a profile view of the gutter screen 1 shown in FIG. 8 and shows channel 1B's rear wall 1B1 to be higher than its front wall 1B2.

Figure 9:
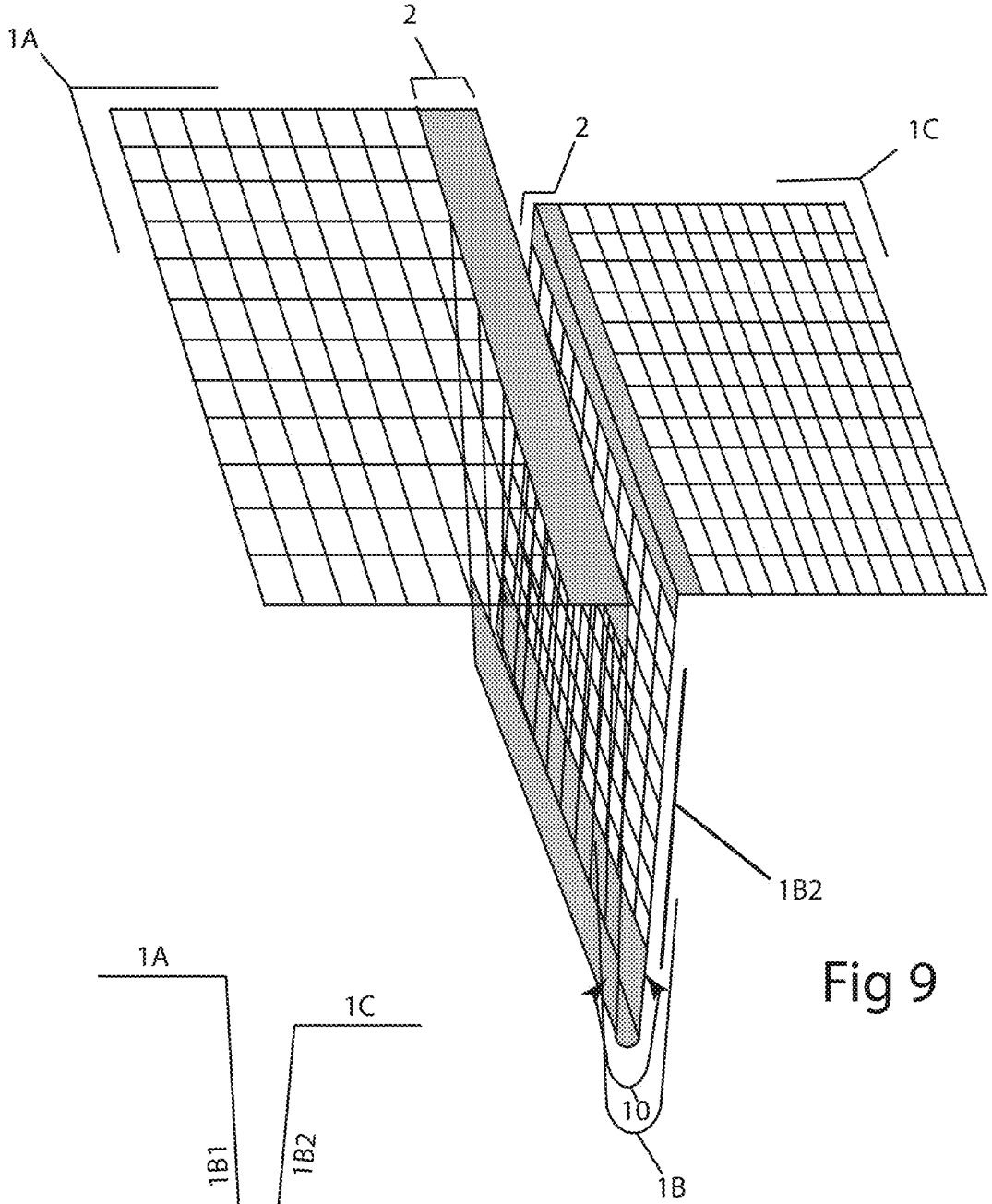
FIG. 9 is a perspective view of an exemplary filtration device in accordance with embodiments of the invention.
Figure 9A:
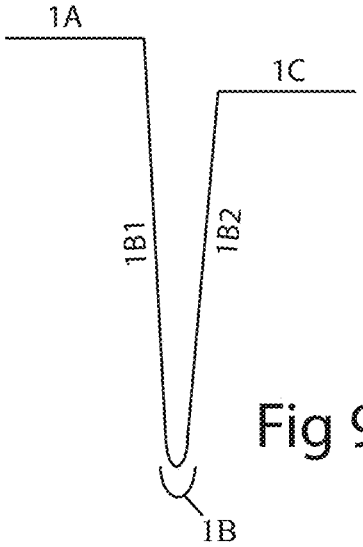
FIG. 9A is a schematic end view of the filtration device of FIG. 9.

FIG. 9 shows an alternative embodiment in which channel 1B is U-shaped and has its rear wall 1B1 rising to a height greater than its front wall 1B2. FIG. 9A is a profile view of the gutter screen 1 shown FIG. 9 and shows channel 1B's rear wall 1B1 to be higher than its front wall 1B2. In embodiments, rear wall 1B1 and front wall 1B2 are in contact with each other for at least a portion of the length of the shorter of rear wall 1B1 and front wall 1B2. In embodiments, rear wall 1B1 and front wall 1B2 are in contact with each other for the entire length of the shorter of rear wall 1B1 and front wall 1B2. In embodiments, rear wall 1B1 and front wall 1B2 are in close proximity to each other for a portion of, or the entire length of, the shorter of rear wall 1B1 and front wall 1B2.

In embodiments, angled-reinforcement bars 2, 3, U-shaped band 10, and/or V-shaped band 11 prevent gutter screen 1 from breaking at its bending points. Such breaking can result from repeated flexing of the screen which can be caused by snow accumulating and thawing. Such breakage can result from repeated flexing of the screen that can occur at the time of the gutter screen's installation due to, for example, the gutter screen being manipulated to achieve a position where the gutter screen's rear edge fits beneath shingles and its front-most edge rests on the front top lip of a rain gutter. Additionally, reinforcement bars 2, 3, U-shaped band 10, and/or V-shaped band 11 help the gutter screen 1's channels maintain their shape. Channels (for example, channels 1B and 1D) and their attendant angled-reinforcement bars and/or U-shaped or V-shaped bands may be used at any location in the body of the gutter screen and not just in the locations shown in illustrations.

There are several methods of affixing angled reinforcement bars 2,3, U-shaped band 10, V-shaped band 11 and/or other solid material elements to the screen body of gutter screen 1. One method is to roll form the screen body and crimp angled reinforcement bars 2, 3, U-shaped bands 10 and/or V-shaped bands 11 of solid material onto the screen body as gutter screen 1 itself is being shaped by a roll-forming machine. Another method is to crimp and/or glue angled reinforcement bars 2, 3, U-shaped bands 10, and/or V-shaped bands 11 in place as a secondary operation after the screen body has been pressed or roll-formed into shape.

Figure 21:
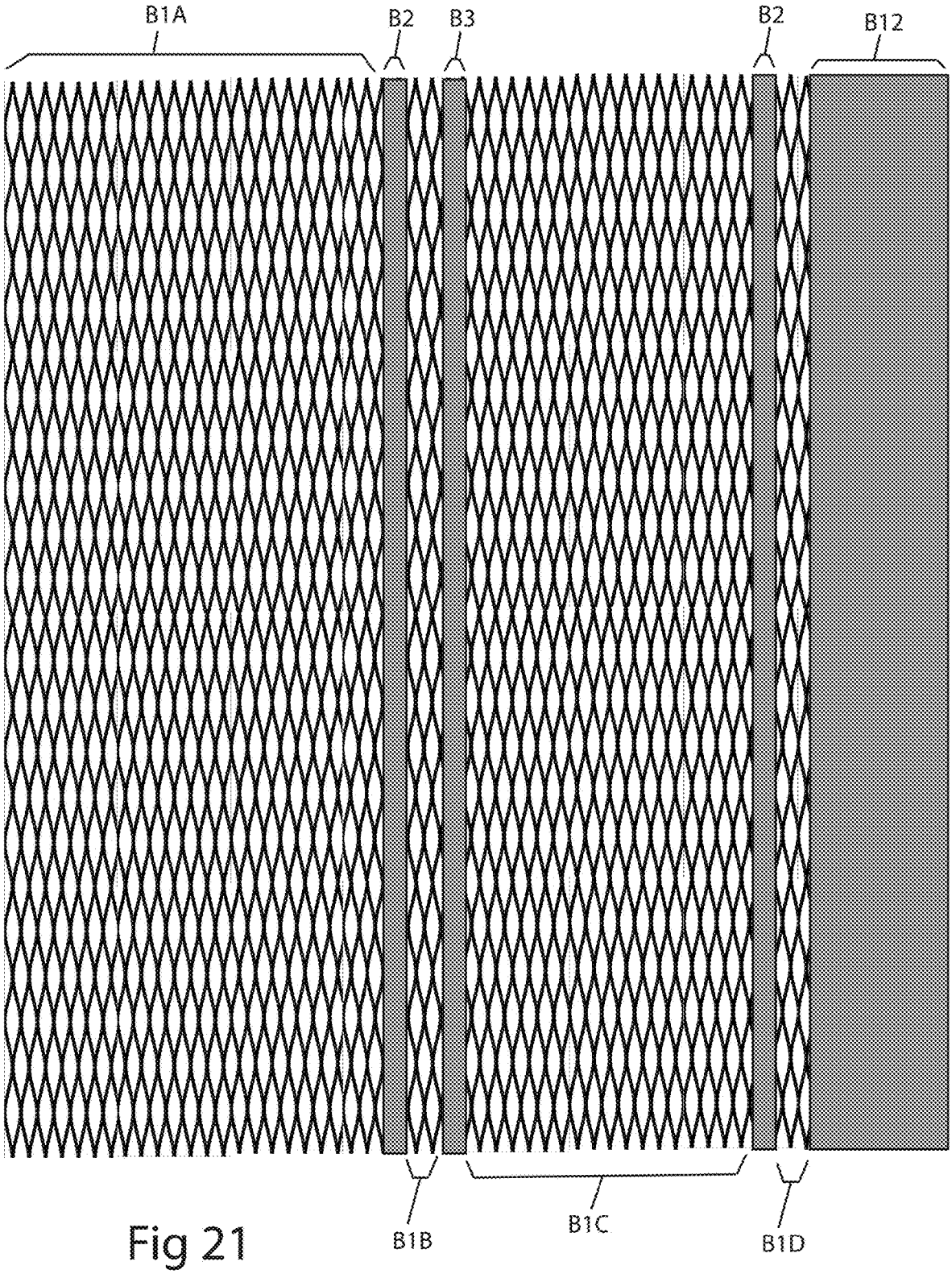
FIG. 21 is a top view of an exemplary filter device in accordance with embodiments of the invention.
Figure 22:
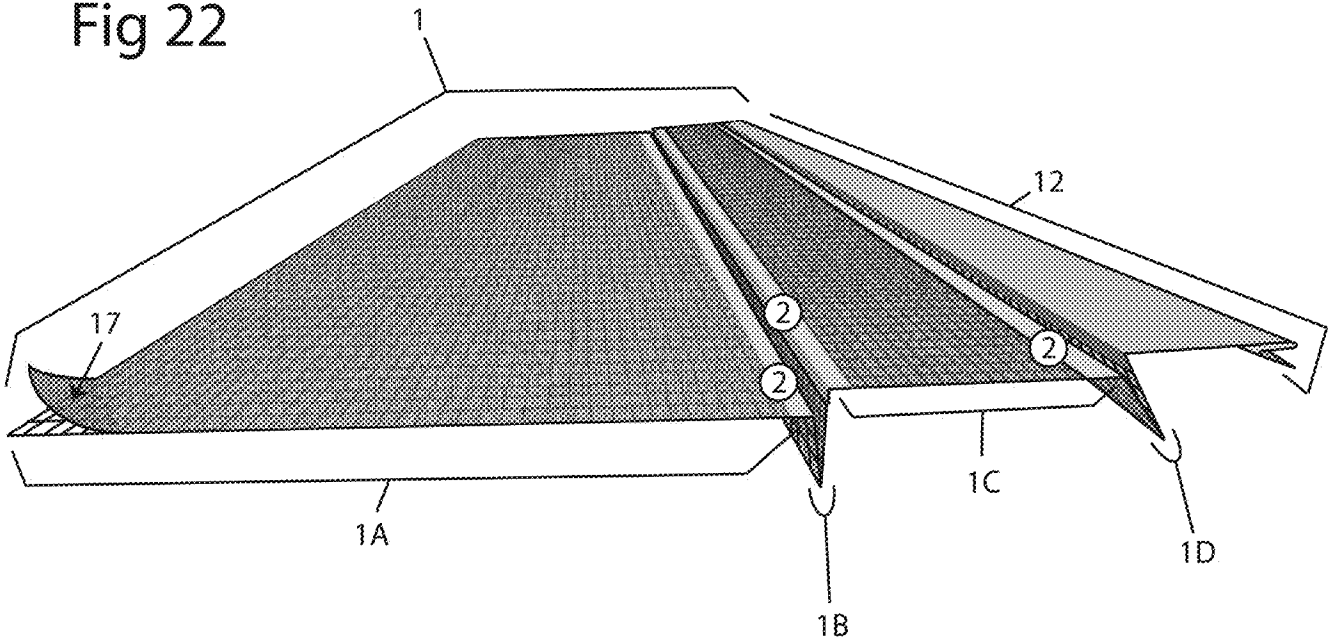
FIG. 22 is a perspective view of an exemplary filter device in accordance with embodiments of the invention.

In embodiments, solid material elements such as angled reinforcement bars 2, 3, U-shaped bands 10, and/or V-shaped bands 11 are an intrinsic part of the gutter screen. For example, in embodiments having the screen formed from expanded metal, angled reinforcement bars 2, 3, U-shaped bands 10, and/or V-shaped bands 11 are areas that remain unpunched while forming the expanded metal sheet. For example, FIG. 21 shows a metal blank having holes or opening (for example, an expanded metal blank) that has areas B1A, B1B, B1C, B1D of diamond-shaped perforations that were punched into solid material, and areas B2, B3, B2, B12 of the solid material that remain unperforated. FIG. 22 illustrates the areas B2, B3, B2, B12 present in the flat-surfaced "blank" of FIG. 21 having been pressed or roll-formed into the angled-reinforcement bars 2, 2, 2, and the solid front cover 12. Forming areas of the gutter screen (for example, gutter screen 1) that bend with solid material or overlaying and/or underlaying those areas with solid material guards against breakage that can occur at bends due to flexing of the material (such as metal) at the areas of bend. It is noted that the perforations in FIG. 22 are shown as square as an alternate shape of the perforations. The above description applies to expanded/perforated screens of all shapes. Embodiments have openings that are louvers, perforations, punched holes, and/or any other form of opening. Embodiments include a filter fabric or other filter material positioned on top of, below, or both on top of and below, the metal blank.

Figure 10:
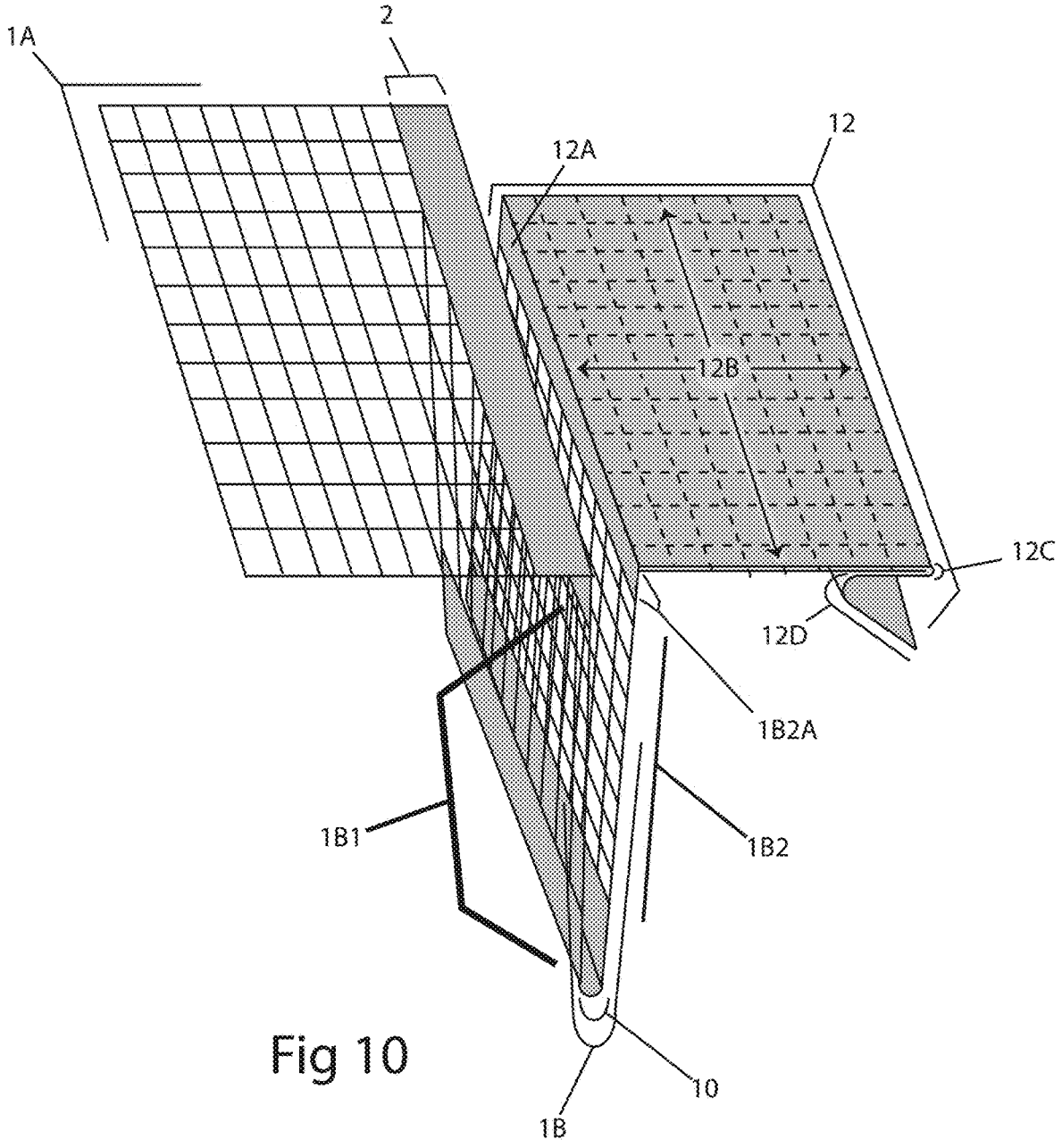
FIG. 10 is a perspective view of an exemplary filtration device in accordance with embodiments of the invention.
Figure 11:
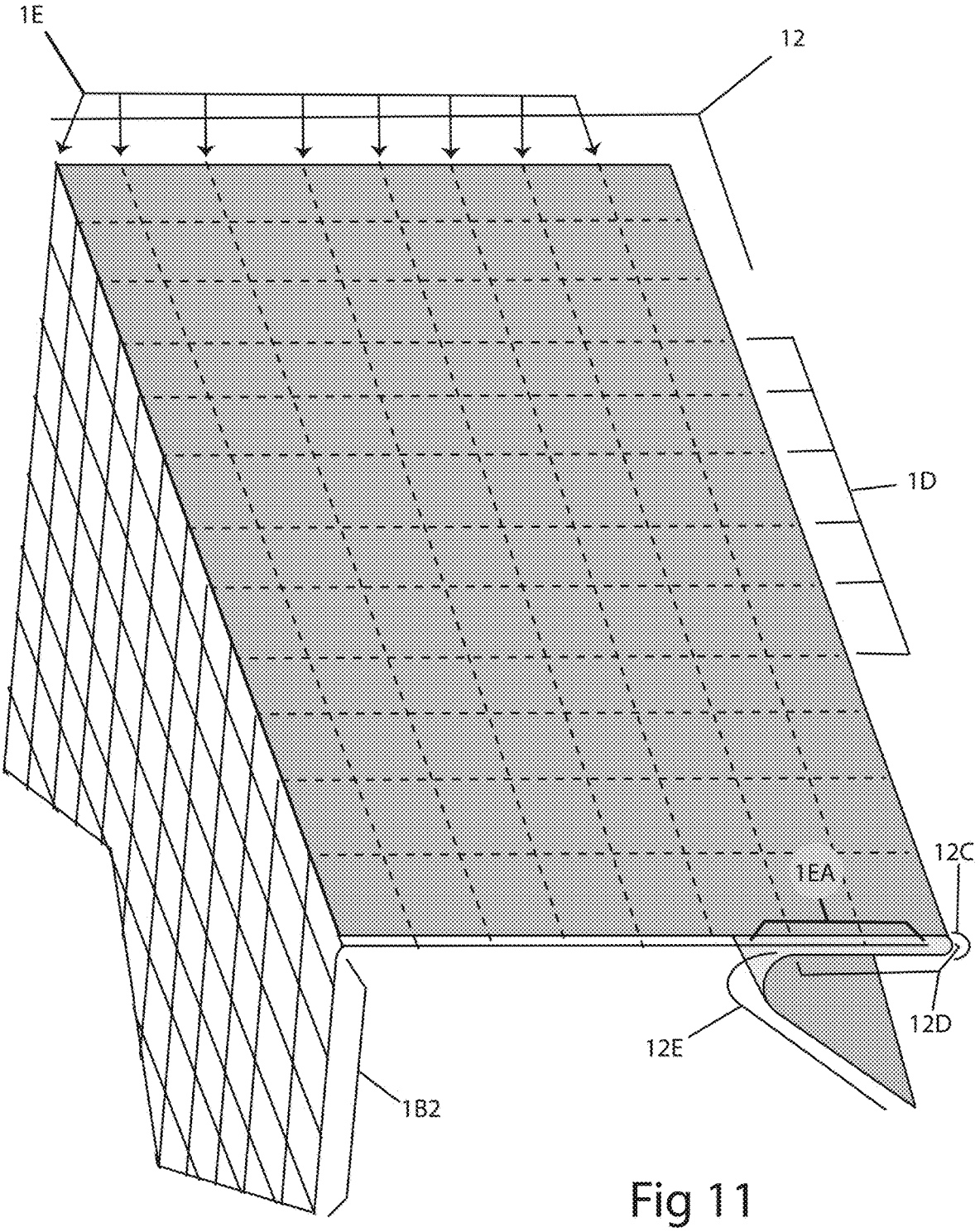
FIG. 11. is a magnified view of a portion of FIG. 10.
Figure 23:
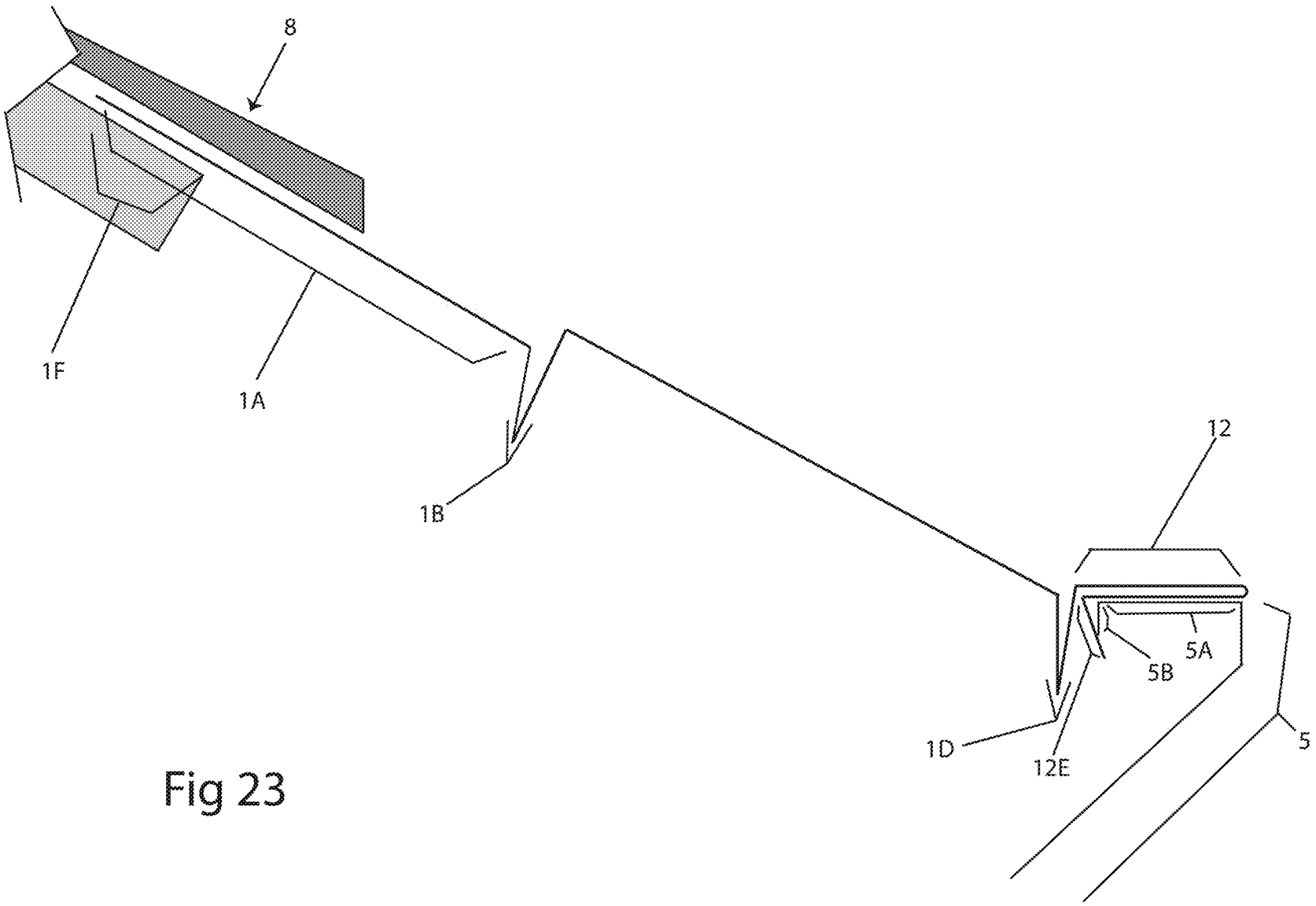
FIG. 23 is an end view of an exemplary embodiment of the invention including a filtration device installed on a rain gutter.

FIGS. 10 and 11 show a solid-material front cover 12 as a non-intrinsic element of the screen body of gutter screen 1 that is glued and/or crimped onto gutter screen 1's plane 1E. In this embodiment, front cover 12 has a plane 12A that extends into channel 1B and contacts a portion 1B2A of front wall 1B2, an upper plane 12B, and a U-shaped bend 12C. In this embodiment, a front portion 1EA of plane 1E is shown inserted into a channel 12D of front cover 12. At the rear entrance of channel 12D, a lower plane of channel 12D is shown transitioning downward into an angled plane 12E. As shown in FIG. 23, downward-extending angled plane 12E is configured to contact a rear plane 5B that extends downward from a top plane 5A of a rain gutter 5's gutter lip, helping secure gutter screen 1 in place by preventing a forward shifting of gutter screen 1.

Figure 13:
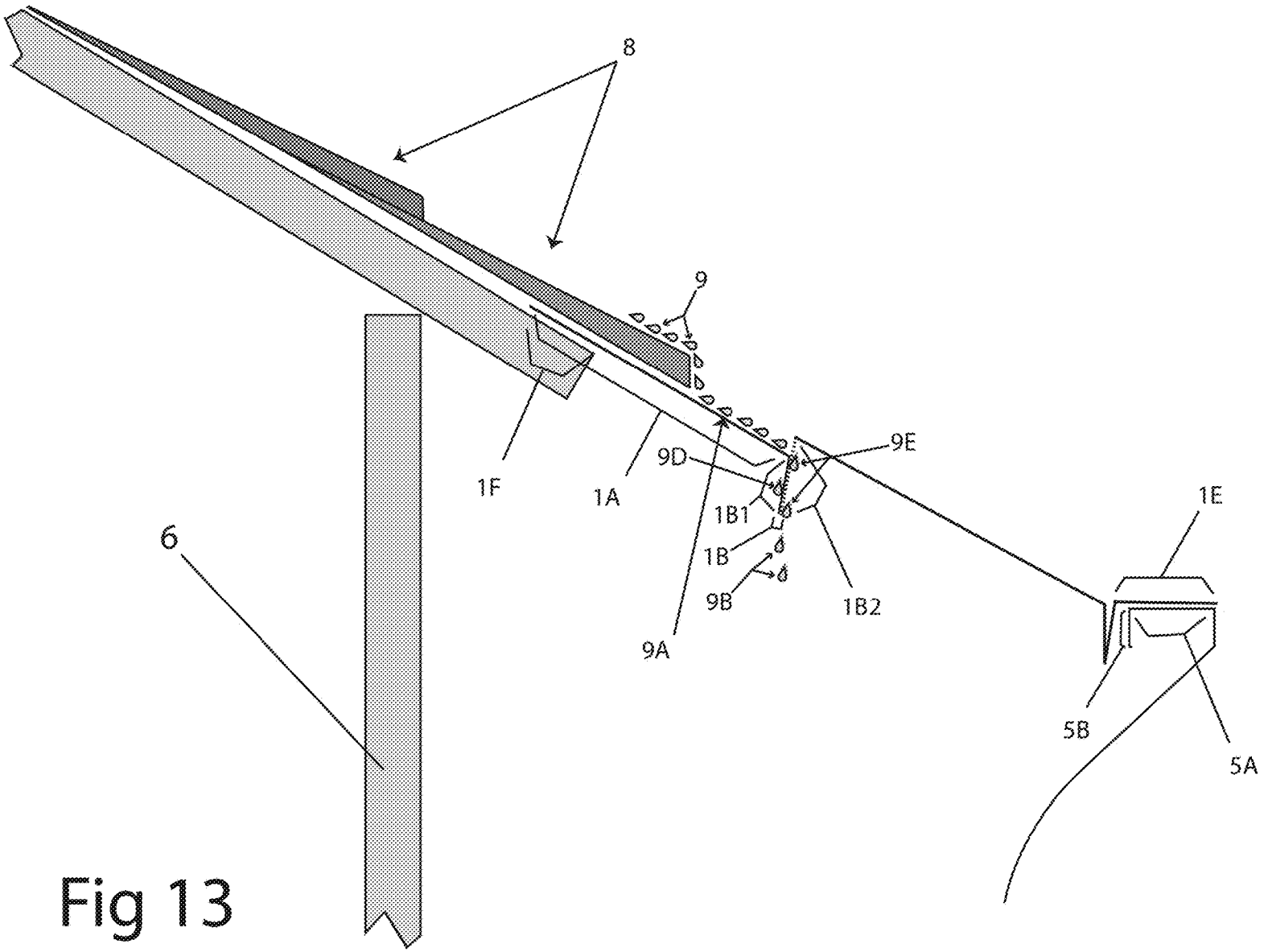
FIG. 13 is a view of the embodiment shown in FIG. 12 showing an example of rain being interdicted and directed downward.

FIG. 13 illustrates an advantage of having front wall 1B2 of channel 1B extend upward to a greater height than rear wall 1B1 of channel 1B. FIG. 13 shows rain drops 9 that flow off shingles 8 of a roof and contact gutter screen 1 on plane 1A may not always immediately drop through gutter screen 1 into an underlying rain gutter 5. Without embodiments of the invention, rain 9 can flow on the top surface of a gutter screen all the way to the front top lip 5A of rain gutter 5 and then flow across the rain gutter's front top lip 5A and past the gutter. To prevent or lessen this top-of-screen forward water flow, a portion of channel 1B's front wall 1B2 is raised higher than the top edge of rear wall 1B1 so that water 9A will hit the upper portion and have its forward flow impeded and directed downward into channel 1B1 and then drop further downward as 9B into underlying rain gutter 5. Portions of the water that flows down channel 1B will flow down and/or penetrate the walls of channel 1B as shown by reference numbers 9D and 9E.

Figure 14:
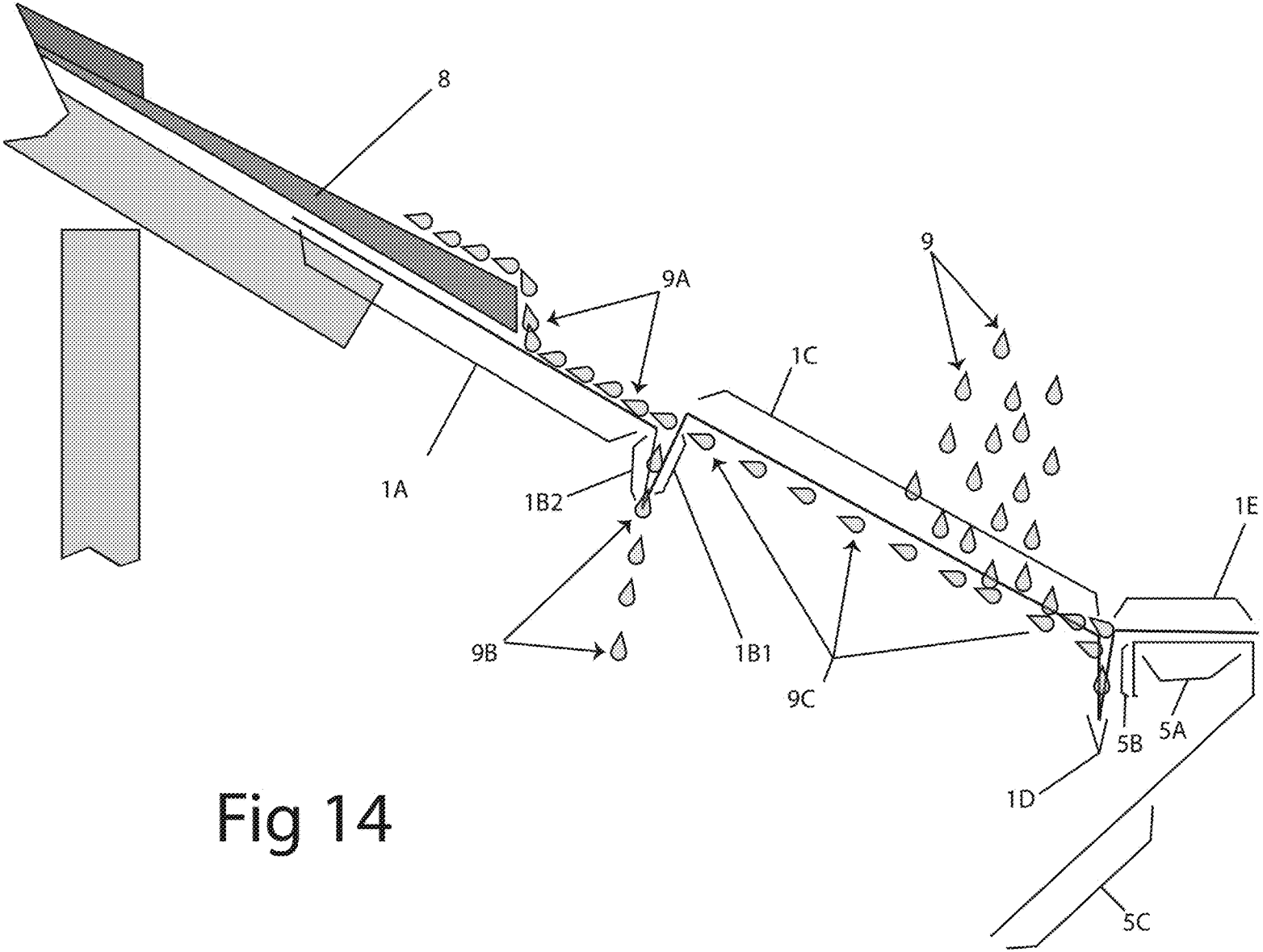
FIG. 14 is a view of the embodiment shown in FIG. 12 showing an example of rain being interdicted and directed downward.
Figure 15:
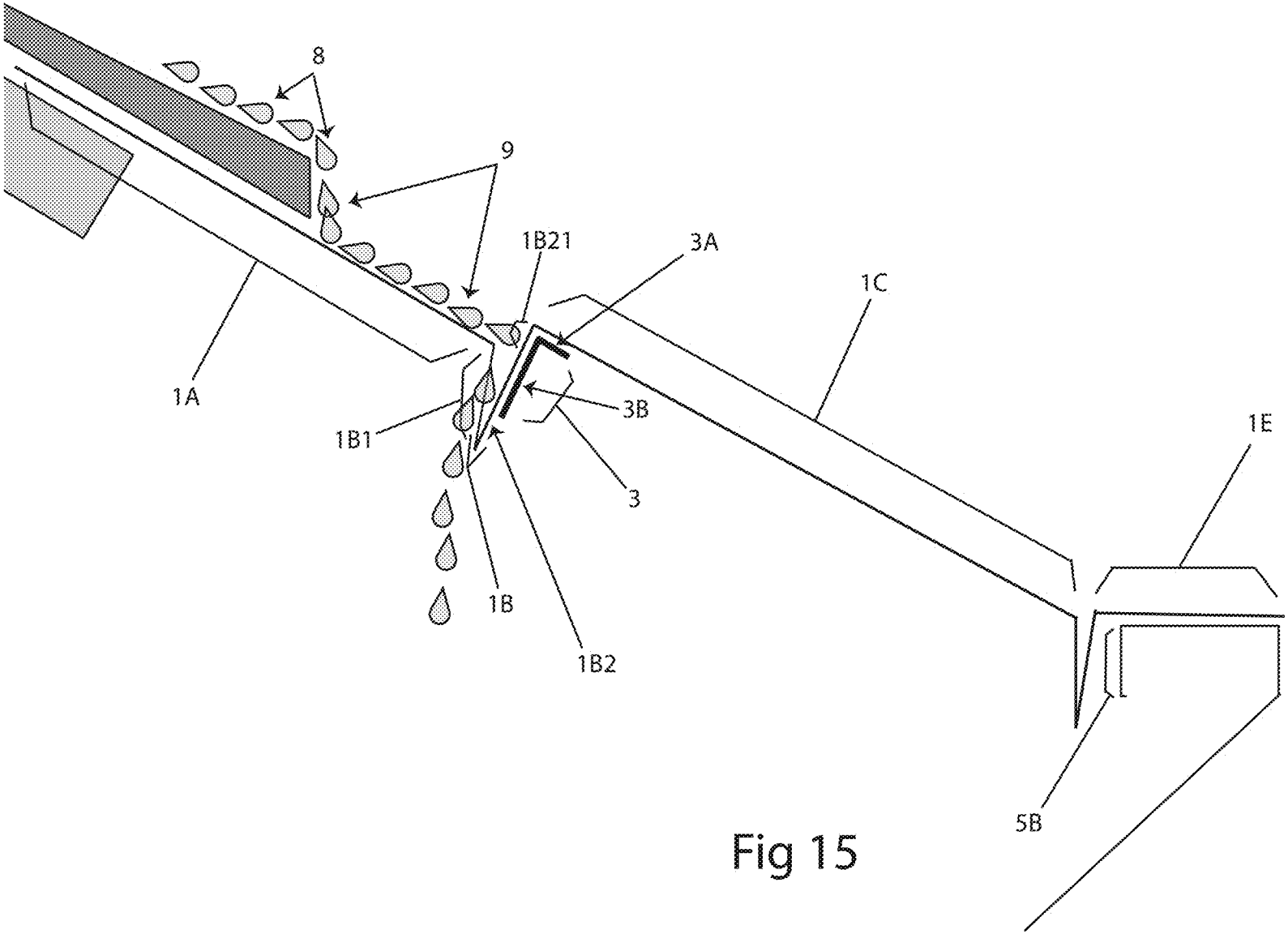
FIG. 15 is a view of an embodiment showing an example of rain being interdicted and directed downward.

Although raising a channel's front wall higher than its rear wall can improve a gutter screen's ability to capture forward flowing water and then direct it downward through a screen's channel (as shown in FIG. 13), a heavy rain can cause a heavy water flow 9A that may partially penetrate an upper portion of front wall 1B2 of channel 1B as illustrated in FIG. 14. FIG. 14 shows a heavy water flow 9A contacting an upper portion of front wall 1B2 of channel 1B with the water then "splitting" into two different flow paths: (1) a flow path 9B dropping down into and through channel 1B into rain gutter 5; and (2) a flow path 9C penetrating the upper portion of front wall 1B2 and then clinging to and flowing forward along the underside of gutter screen 1's plane 1C. FIG. 14 further shows water flow path 9C contacting front wall 1D2 of channel 1D and is directed downward into rain gutter 5. To further prevent water from forward flowing along the top of and along the bottom surface of a gutter screen's water receiving planes, solid-material angled reinforcement bars may be placed, affixed, or designed to be an intrinsic part of, bends that occur at the top of a gutter screen's downward extending channels as is illustrated in FIGS. 15-18. FIG. 15 shows an angled reinforcement bar 3 that is (for example) glued to, sintered to, or crimped to a portion of channel 1B's forward wall 1B2 with a downward extending plane 3B of angled reinforcement bar 3 adjoining a portion of channel 1B's front wall 1B2 and a top plane 3A of angled reinforcement bar 3 adjoining a portion of the underside of plane 1C. The placement of, or incorporation of, angled reinforcement bar 3 prevents water 9 from flowing through upper portion 1B21 of front wall 1B2 to the underside of plane 1C.

Figure 16:
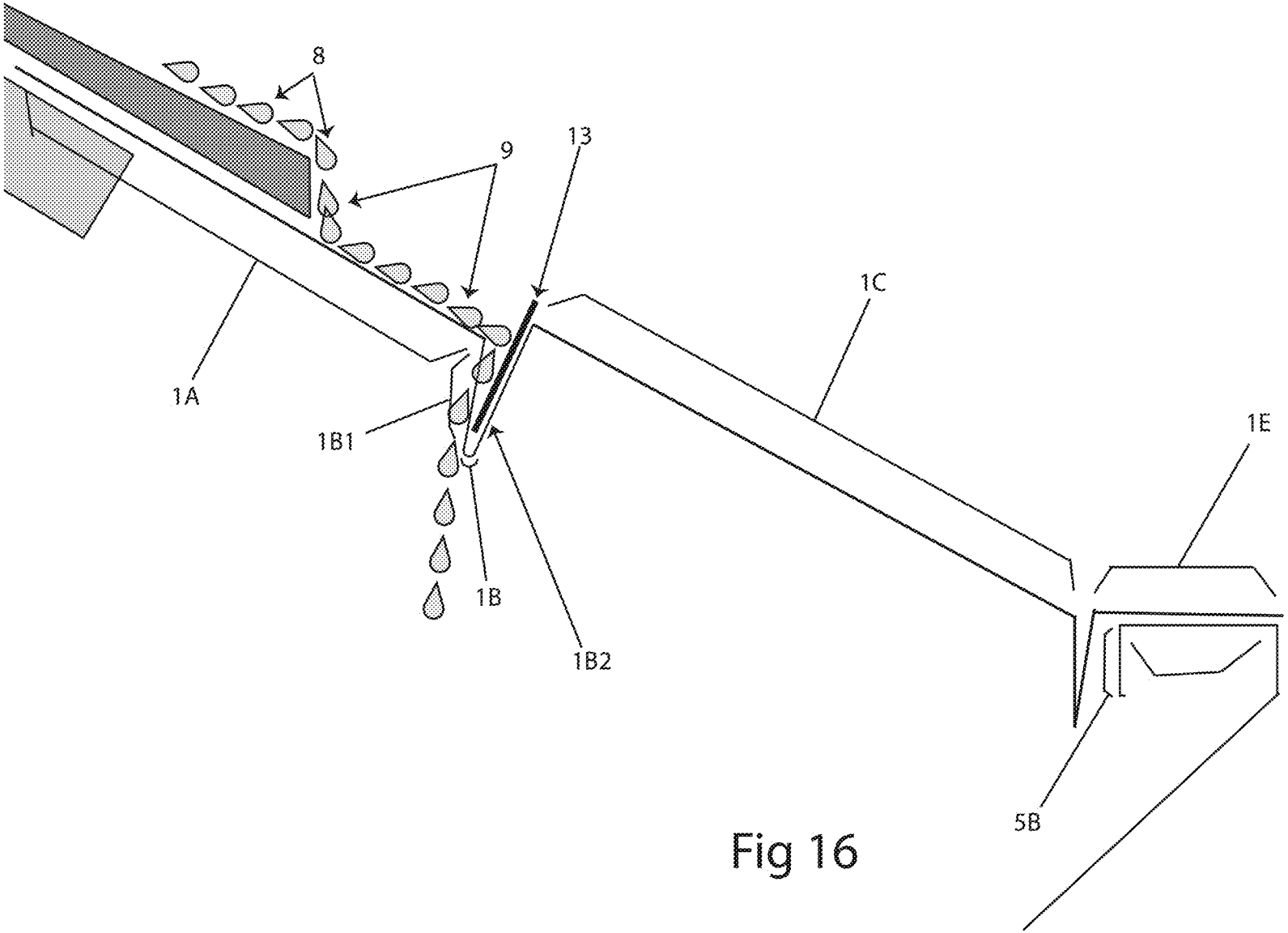
FIG. 16 is a view of an embodiment showing an example of rain being interdicted and directed downward.
Figure 17:
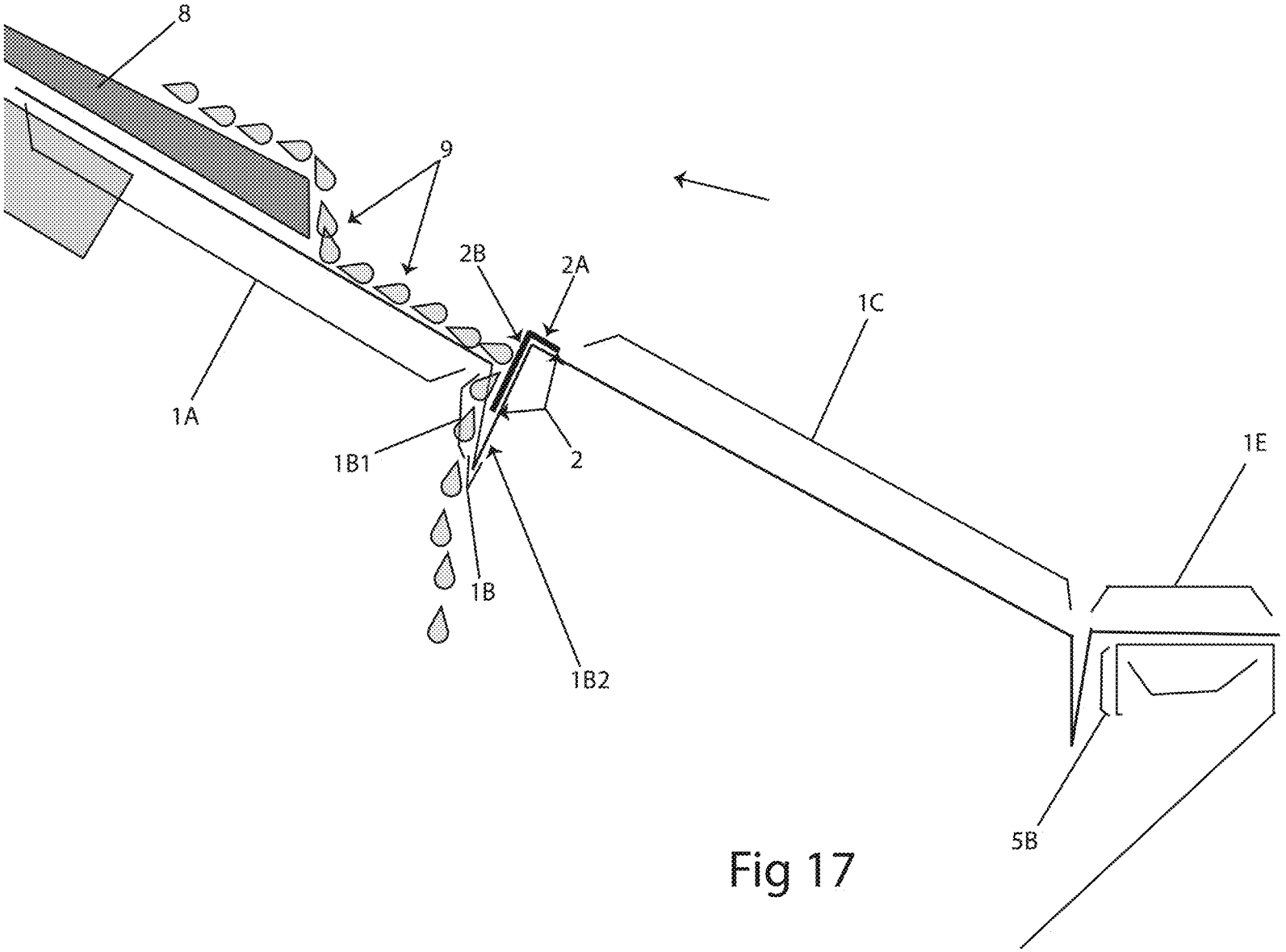
FIG. 17 is a view of an embodiment showing an example of rain being interdicted and directed downward.
Figure 18:
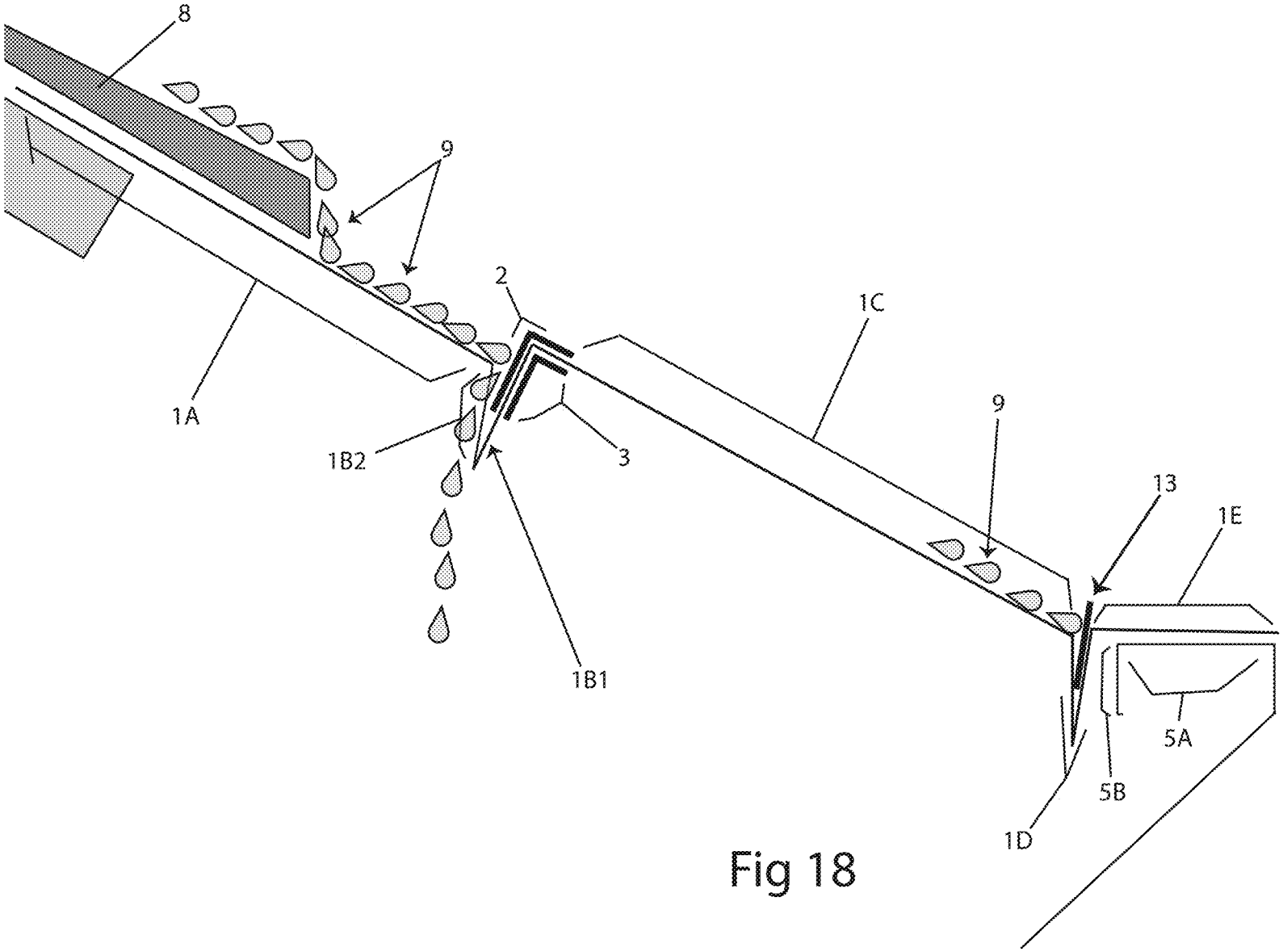
FIG. 18 is a view of an embodiment showing an example of rain being interdicted and directed downward.

FIGS. 16-18 show different examples of embodiments of the gutter screen 1 shown in FIG. 15, demonstrating that, in embodiments, angled reinforcement bars or straight or other-shaped planes are placed in different positions in or on a downward extending channel to achieve inhibiting of forward water flow through a downward extending channel's front wall. FIG. 16 shows a plane of solid material 13 inserted into channel 1B to prevent the forward flow of water through upper portion 1B21 of front wall 1B2 of channel 1B. FIG. 17 shows an angled reinforcement bar 2 being placed atop, rather than beneath, the bend that occurs when the top edge of front wall 1B2 transitions into plane 1C. FIG. 18 shows angled reinforcement bars 2, 3 sandwiching the bend that occurs when the top edge of front wall 1B2 transitions into plane 1C. FIG. 18 also shows a solid material plane 13 inserted into channel 1D. FIG. 18 shows that embodiments of the invention include angled-reinforcement bars and planes as taught herein employed within, atop of, and/or beneath any downward extending channel present in the gutter screen, with the angled-reinforcement bars and planes being secured by (for example) sintering, gluing, crimping, or by other means of attachment.

An advantage of solid material plane 13 is that it stops forward flowing water 9 that may cling to plane 1C from contacting the front top lip 5A of rain gutter 5's gutter lip, and then diverts the water downward into and through channel 1B, 1D into the underlying gutter. As noted earlier, angled reinforcement bars 2, 3 may be intrinsically a part of, rather than attached to, a gutter screen as illustrated in FIG. 22. Also shown in FIG. 22 is an overlay 17 that overlays either a screen, expanded metal, or other underlying structure. In embodiments, the underlying structure includes openings that, for example, permit water to flow through the underlying structure. In embodiments, overlay 17 is a screen such as, for example, a screen that is finer (has smaller openings) than the underlying structure.

Referring to FIG. 8, embodiments inhibit water flowing across the top of a screen such as plane 1A, from spanning the open-air gap at the top of a downward extending channel (such as channel 1B) and then clinging to and forward along the top edge of a succeeding plane such as plane 1C. Such spanning can occur when a channel's front and rear walls terminate at heights that make their top edges in line with one another. By having rear wall 1B1 of channel 1B rise higher than front wall 1B2 (and especially when rear wall 1B1 has an angled reinforcement bar atop or beneath the bend present at the top of rear wall 1B1), as water present on or under plane 1A contacts the solid material of angled reinforcement bar 2, the water will tend to cling to both the top and bottom surface of top plane 2A and will tend to cling to both the front and rear surfaces of downward extending plane 2B flowing down into and through, rather than past, channel 1B.

FIGS. 12 and 23 show gutter screen 1 having rear portion 1F of its rear plane slid beneath shingles 8 to help secure gutter screen 1 in place. FIG. 19 shows rear portion 1F of plane 1A of gutter screen 1 bent upward and placed against a facia board to help secure gutter screen 1 in place. FIG. 20 shows rear portion 1F of rear plane 1A of gutter screen 1 alternatively bent downward so that its terminal edge 1F1 rests atop a gutter hanger 15 to help secure gutter screen 1 in place.

Figure 23A:
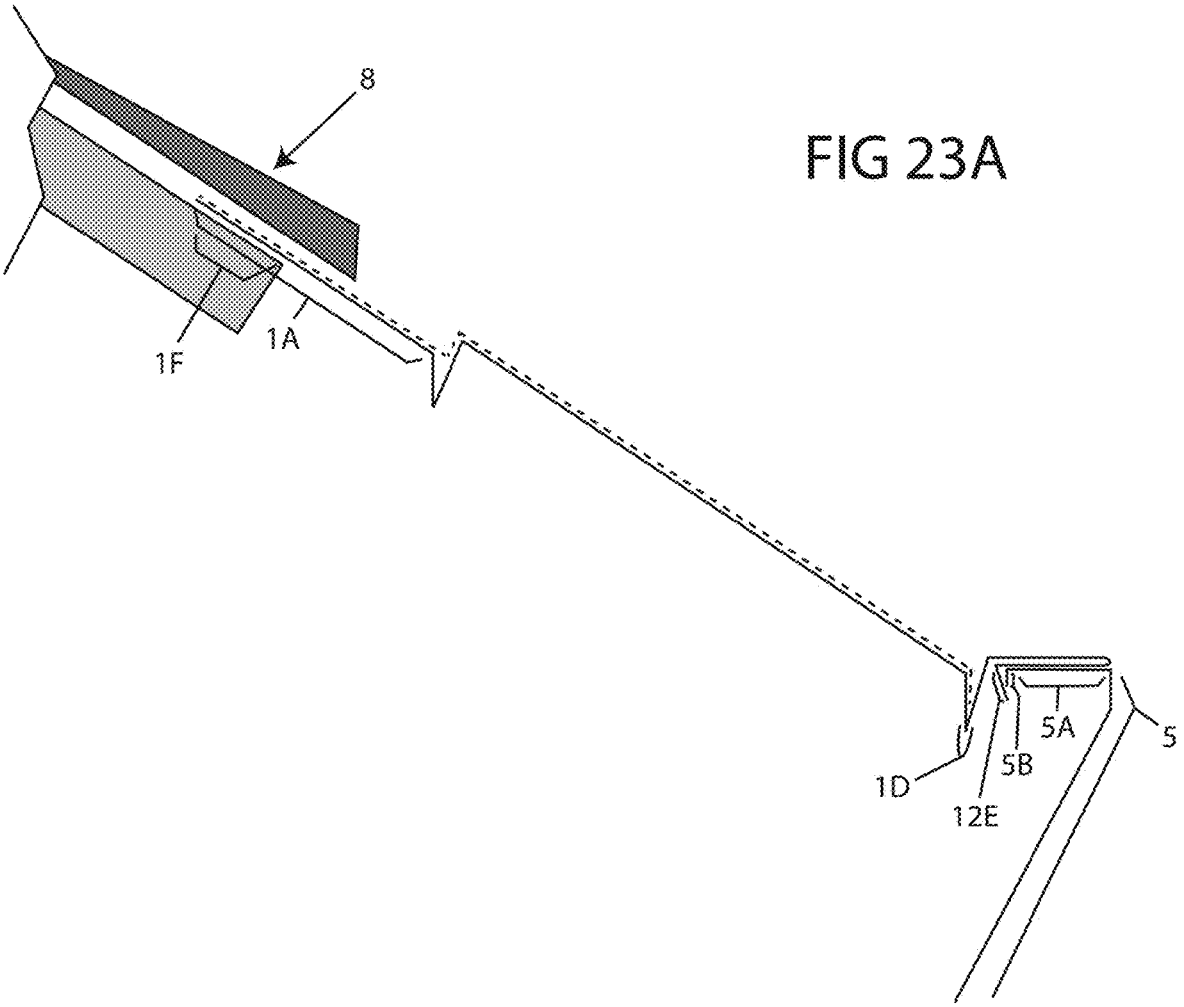
FIG. 23A is an end view of an exemplary embodiment of the invention including a filtration device installed on a rain gutter.
Figure 23B:
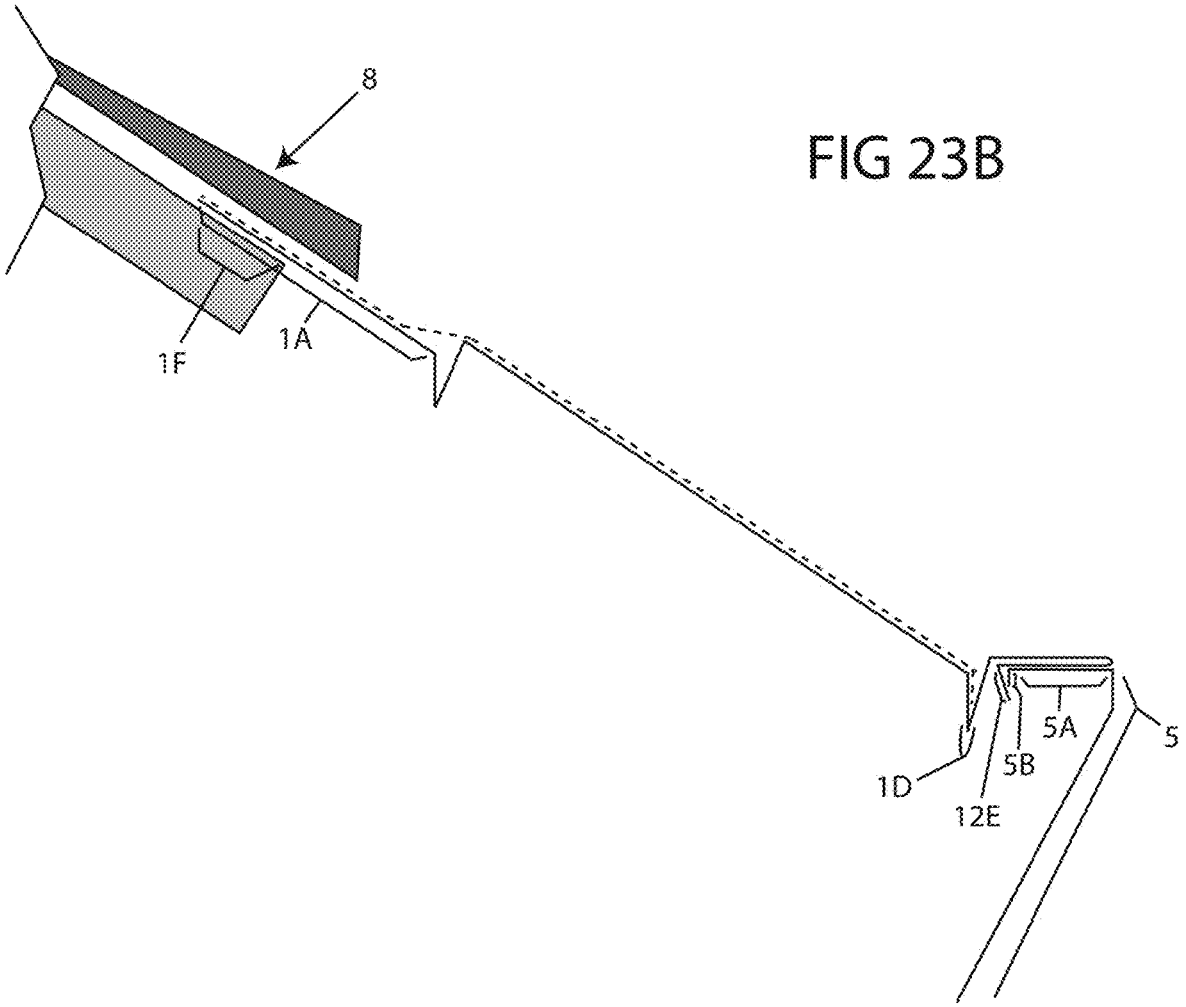
FIG. 23B is an end view of an exemplary embodiment of the invention including a filtration device installed on a rain gutter.
Figure 23C:
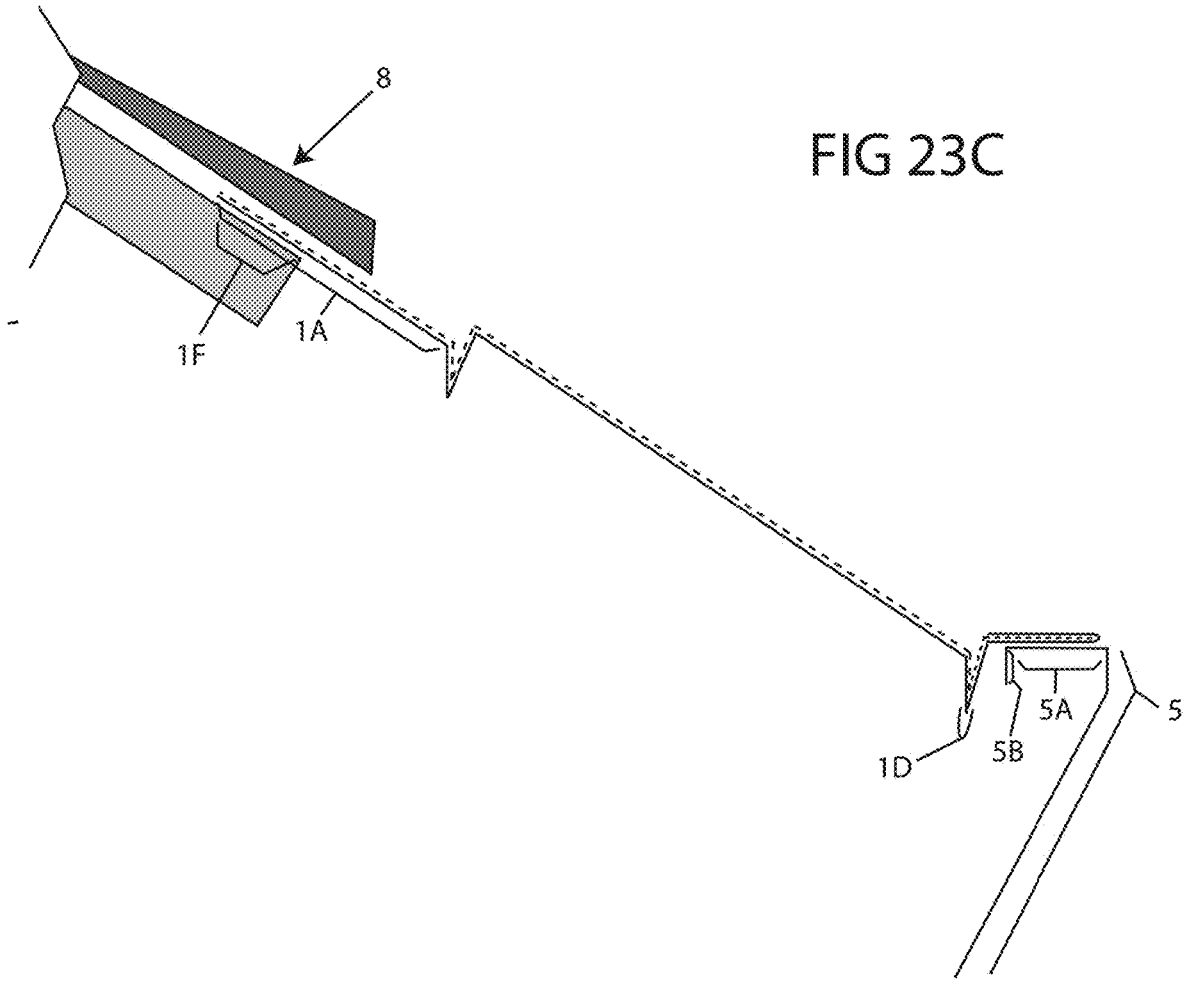
FIG. 23C is an end view of an exemplary embodiment of the invention including a filtration device installed on a rain gutter.

FIGS. 23A-23C show examples of embodiments having an overlay 17 overlaying either a courser screen, expanded metal, or other underlying structure. In FIG. 23A, overlay 17 extends over channel 1B in a straight line to contact front wall 1B2 of channel 1B and does not extend into channel 1B. In FIG. 23B, overlay 17 extends over channel 1B in an angled line, does not contact front wall 1B2 of channel 1B and does not extend into channel 1B. In FIG. 23C, overlay 17 extends down into and follows the contour of channel 1B. FIG. 23C also shows an embodiment in which overlay 17 extends into a receiving area at a lower end of the underlying structure.

Figure 24:
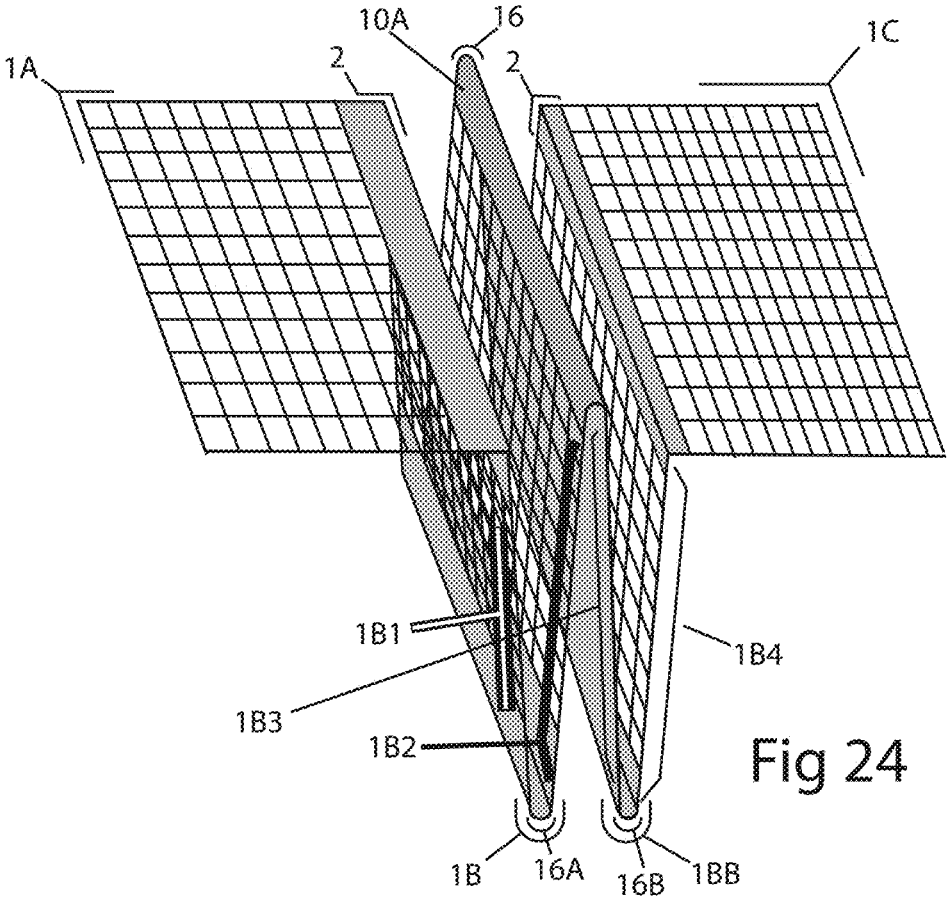
FIG. 24 is a partial perspective view of an exemplary filter device in accordance with embodiments of the invention.
Figure 25:
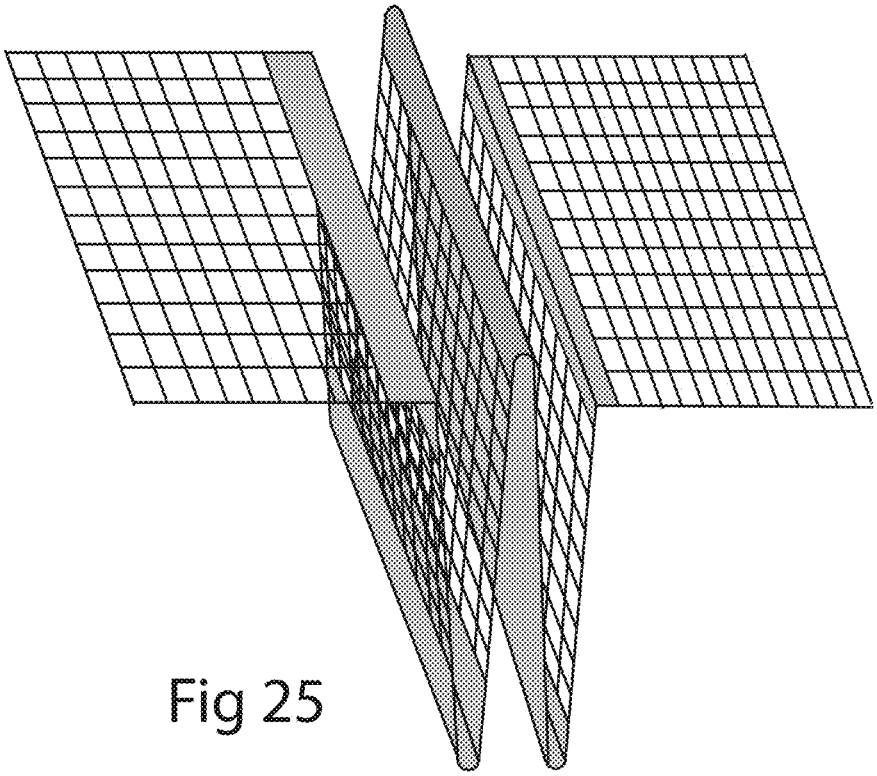
FIG. 25 is a duplicate of FIG. 24 without reference numbers.

FIGS. 24 and 25 show an embodiment that has two downward extending channels 1B and 1BB beside one another. The double-channel configuration is formed by having plane 1A bend downward to form rear wall 1B1, which curves upward at a U-shaped curve 16A at its lowest point into front wall 1B2. Front wall 1B2, has a U-shaped curve 16 at its upper edge that is optionally capped by (or intrinsically formed by) U-shaped solid material 10A with the curve 16 forming the apex of front wall 1B2 and a rear wall 1B3. Rear wall 1B3 extends downward and then curves upward at U-shaped curve 16B at its lowest point into front wall 1B4. Front wall 1B4 bends at its apex to join with plane 1C. In FIG. 24, rear wall 1B3 is shown being of solid rather than a screen material. In embodiments, downward-extending solid material that contacts water flow more effectively causes water to be directed downward than a downward-extending porous screen. In embodiments, the double-channel formation of FIG. 24 is employed at any location of gutter screen 1. Double-channels or W-shaped channels (as shown in FIG. 24, for example) having the first two downward extending walls (1B1, 1B2) being screened material, the third wall (1B3) being partially or completely solid, and the fourth wall (1B4) being screened material are very effective at channeling water flowing on or through a screen and downward into an underlying gutter. FIG. 25 is a view of the double-channel configuration shown in FIG. 24, but shown having no reference numerals to allow an uncluttered view of the double channel. The embodiments shown in FIGS. 24-28 (and other embodiments) can be formed from one material. The embodiments shown in FIGS. 24-28 (and other embodiments) can be made without some or all of the caps and/or reinforcement bars shown in FIGS. 24 and 25. In embodiments, any or all of the walls are in contact with each other for at least a portion of the length of the shorter of the walls. In embodiments, any or all of the walls are in contact with each other for the entire length of the shorter of the walls. In embodiments, any or all of the walls are in close proximity to each other for a portion of, or the entire length of, the shorter of the walls.

Figure 26:
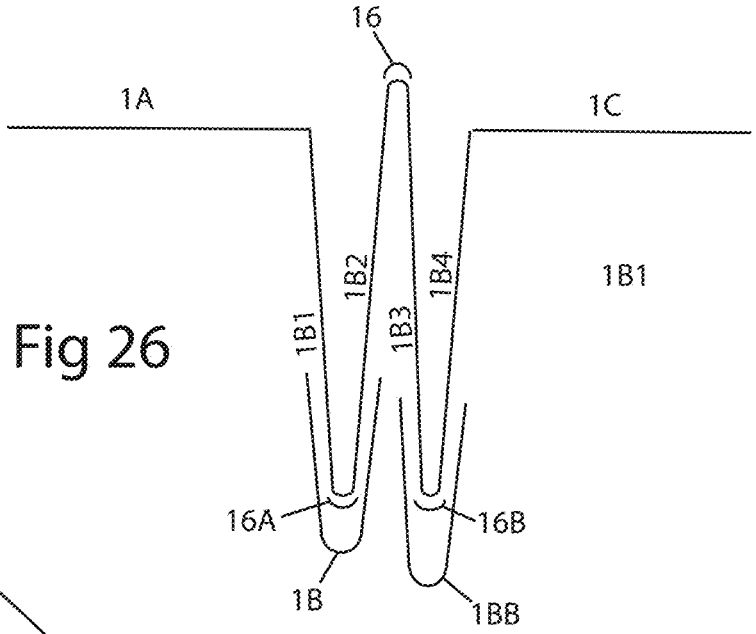
FIG. 26 is a schematic partial end view of the embodiment of FIG. 24.
Figure 28:
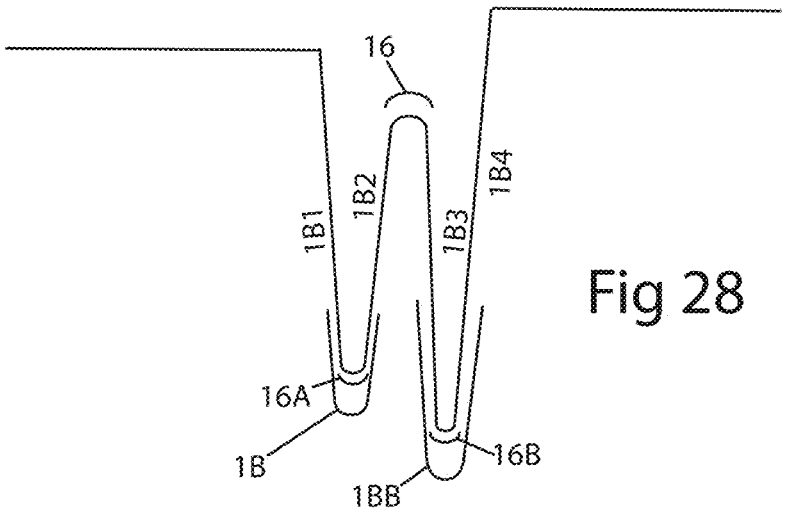
FIG. 28 is an exemplary alternate embodiment of the embodiment of FIG. 24.

FIG. 26 is a profile view of the embodiment shown in FIG. 24 and shows walls 1B2 and 1B3, and U-shaped curve 16 that joins them, rising to a height greater than rear wall 1B1 and front wall 1B4. FIG. 28 shows an embodiment in which channels that form a W configuration may extend downwardly at different lengths with, in this example, channel 1BB shown extending to a lower depth than channel 1B. FIG. 28 also shows that, in embodiments, front wall 1B2 and rear wall 1B3 terminate at a height lower than that of rear wall 1B1 and front wall 1B4. In embodiments, the relative heights of the walls shown in FIG. 26 can be reversed.

Figure 27:
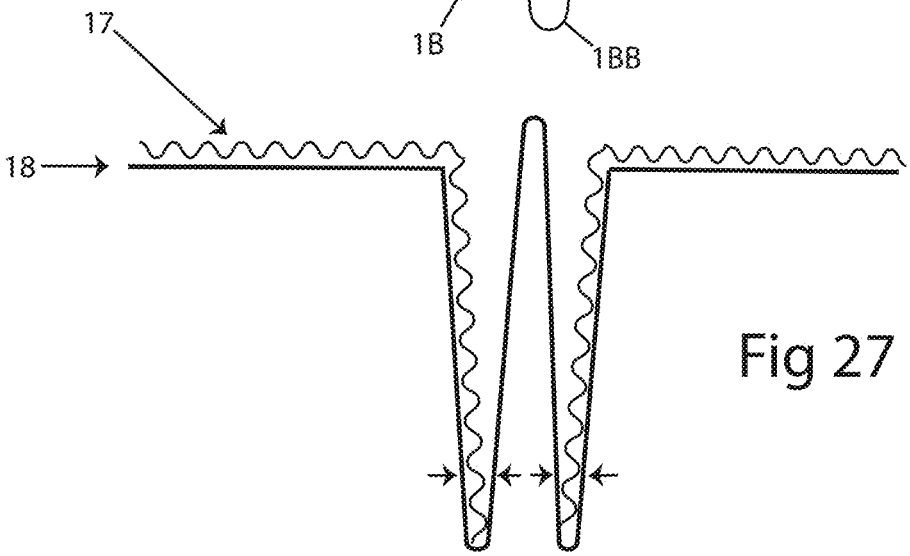
FIG. 27 is an exemplary alternate embodiment of the embodiment of FIG. 24.

FIG. 27 shows an embodiment in which an overlay 17 overlays either a coarser screen or expanded metal 18. In FIG. 27, overlay 17 is not shown overlying walls 1B2 or 1B3, although it does in other embodiments. The arrows on each side of channels 1B and 1BB indicate that, in embodiments, channels 1B and 1BB are crimped together at the locations indicated by the arrows to help secure overlay 17 in place. In embodiments, channels 1B, 1BB are also (or alternatively) crimped together at other locations on the channels to help secure overlay 17 in place.

Figure 26A:
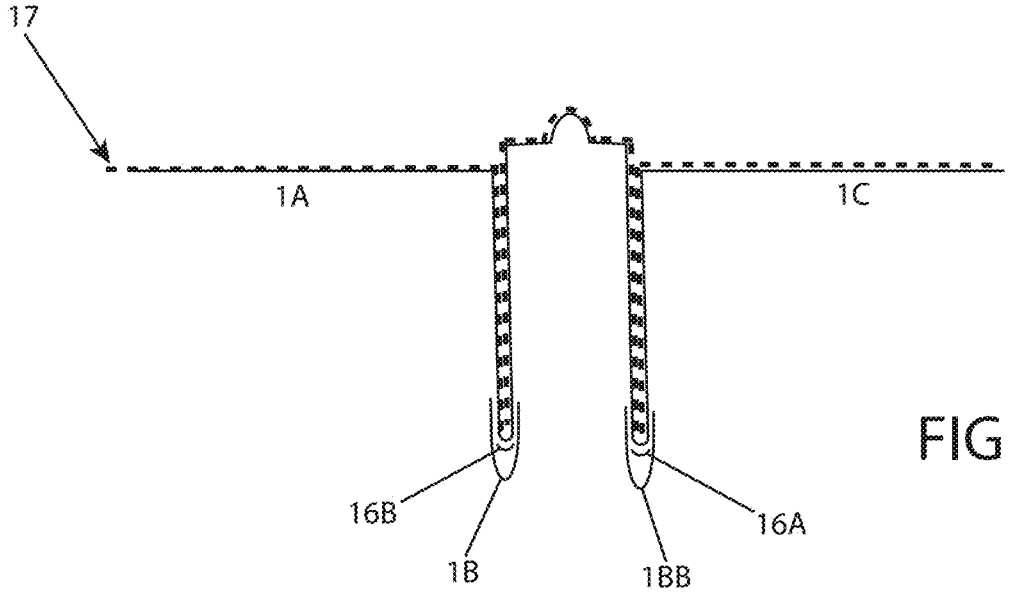
FIG. 26A is a schematic partial end view of an exemplary filter device in accordance with embodiments of the invention.
Figure 26B:
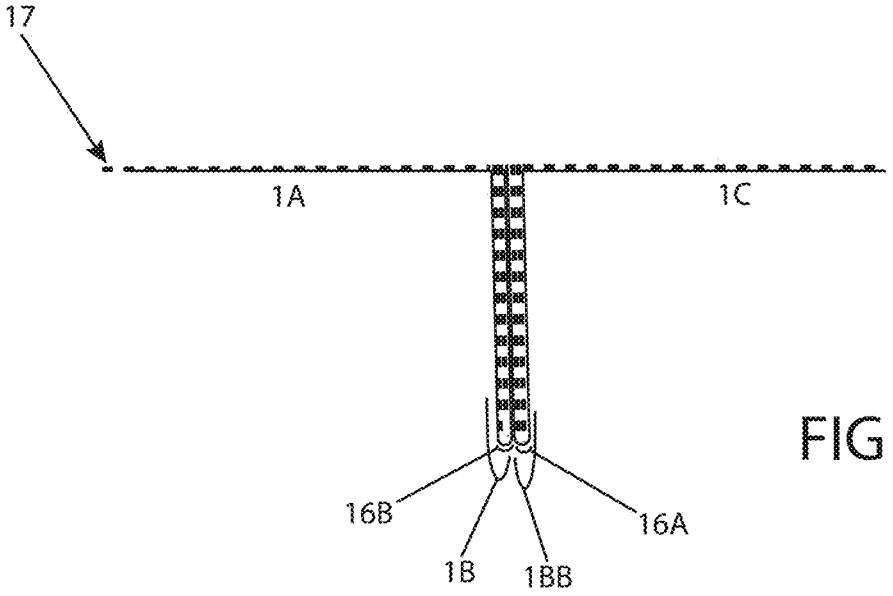
FIG. 26B is a schematic partial end view of an exemplary filter device in accordance with embodiments of the invention.

FIG. 26A shows an exemplary embodiment in which overlay 17 extends down into channels 1B and 1BB, and channels 1B and 1BB do not contact each other. FIG. 26B shows an exemplary embodiment in which overlay 17 extends down into channels 1B and 1BB, and channels 1B and 1BB contact each other.

Figure 27A:
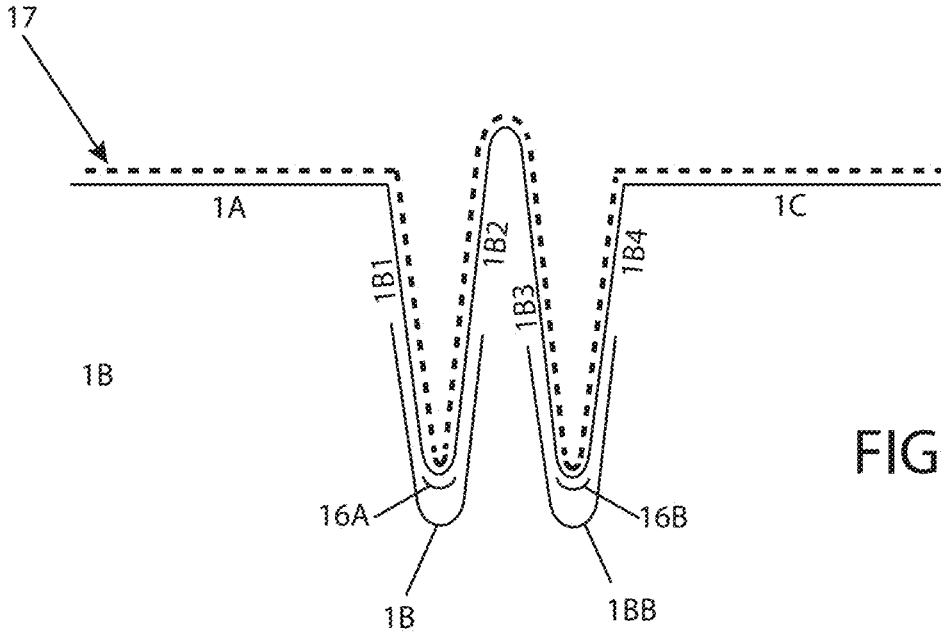
FIG. 27A is an exemplary alternate embodiment of the embodiment of FIG. 24.
Figure 27B:
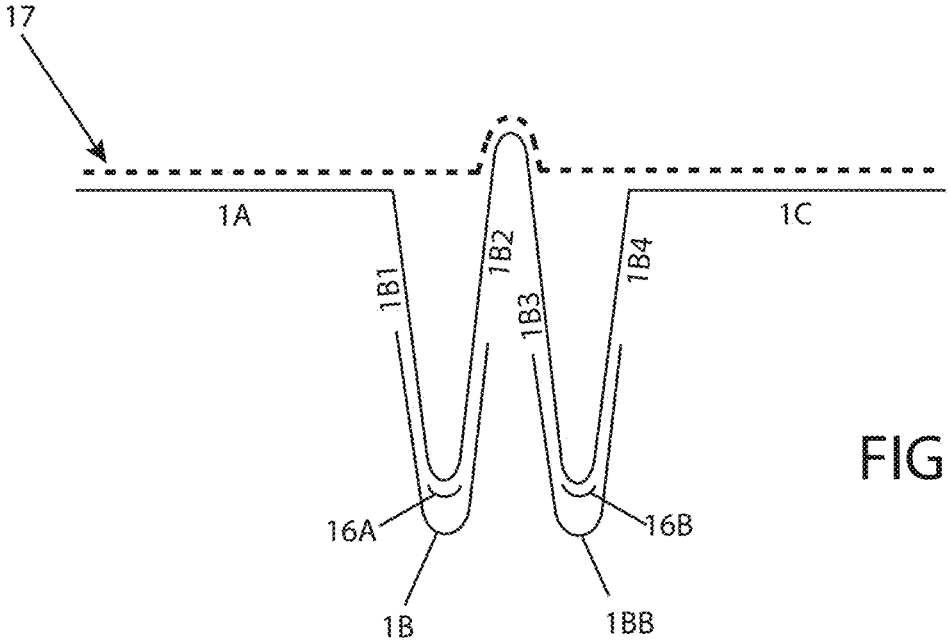
FIG. 27B is an exemplary alternate embodiment of the embodiment of FIG. 24.

FIG. 27A shows an embodiment similar to the embodiment shown in FIG. 27, with overlay 17 extending down into, and following the contour of channels 1B and 1BB. FIG. 27B shows an embodiment similar to the embodiment shown in FIG. 27, with overlay 17 extending over the tops of channels 1B and 1BB.

Figure 29:
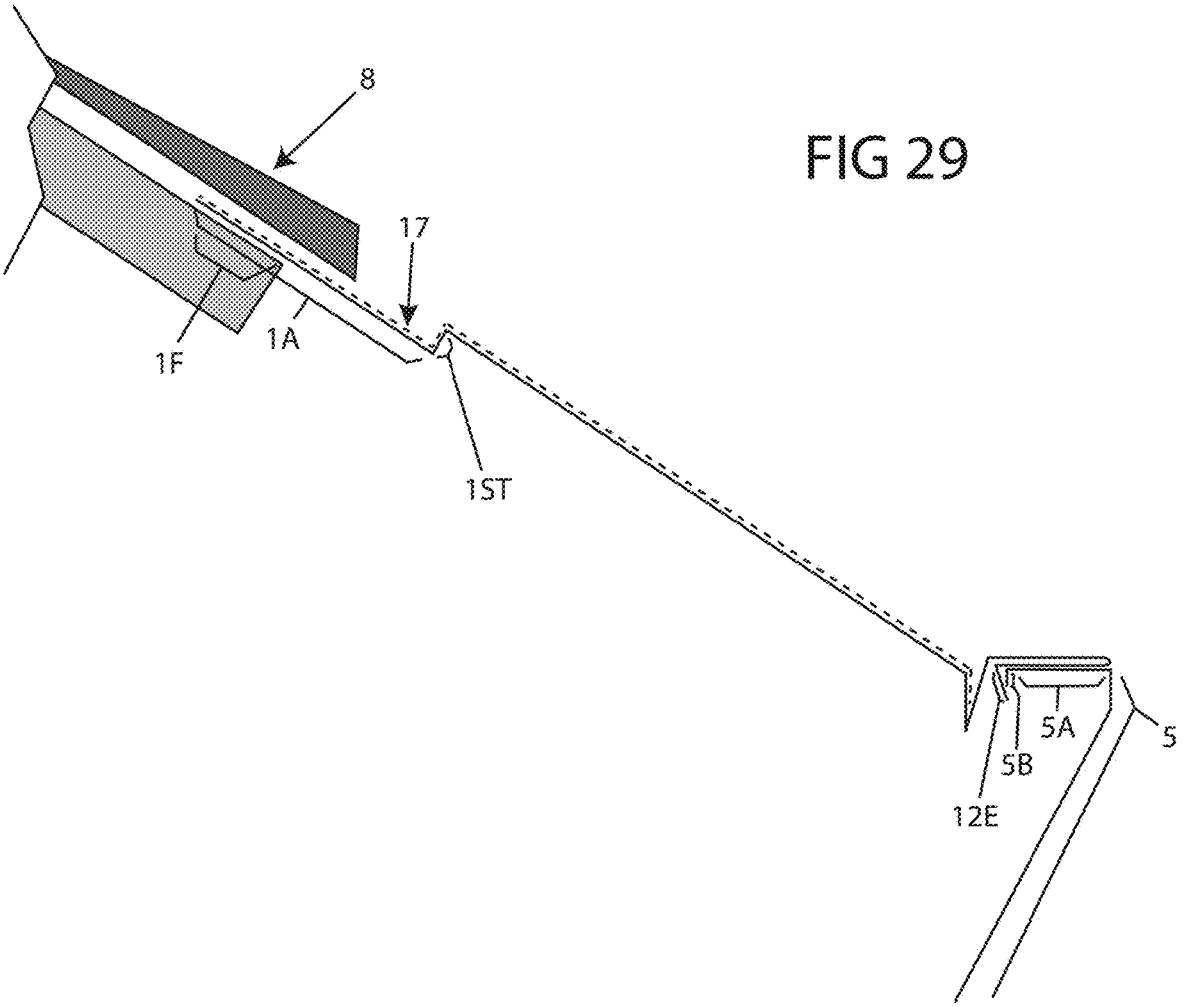
FIG. 29 is an end view of an exemplary embodiment of the invention including a filtration device installed on a rain gutter.

FIG. 29 shows an exemplary embodiment in which gutter screen 1 includes a step 1ST instead of channel 1B. Step 1ST acts in a similar manner to embodiments in which an upper portion of front wall 1B2 extends above the top of rear wall 1B1 (as explained, for example, with reference to FIG. 13). In other embodiments, step 1ST is stepped in the opposite direction that that shown in FIG. 29 and acts in a similar manner to embodiments in which an upper portion of rear wall 1B1 extends above the top of front wall 1B2 (as shown, for example, in FIGS. 8 and 9). In embodiments, an advantage of providing step 1ST is reduced manufacturing costs. In other embodiments, one or more steps (such as step 1ST) are provided. In other embodiments, one or more steps (such as step 1ST) are provided with one or more channels. In embodiments, step 1ST is a singled layer of gutter screen 1. In other embodiments, step 1ST is formed by multiple layers of gutter screen 1 and/or other materials. For example, in embodiments, step 1ST is formed by a single layer of gutter screen 1 and a piece of material added to gutter screen 1. For example, in embodiments, step 1ST is formed by a single layer of gutter screen 1 and a piece of solid or perforated material added to gutter screen 1. In embodiments, step 1ST is formed by a single layer of gutter screen 1 and a piece of perforated material added to gutter screen 1, where the added material has openings that are smaller than the openings in gutter screen 1. In embodiments, step 1ST is formed by multiple layers (for example, three layers) of gutter screen 1 and a piece of solid or perforated material added to gutter screen 1. In embodiments, step 1ST is formed by three layers of gutter screen 1 and a piece of perforated material added to gutter screen 1, where the added material has openings that are smaller than the openings in gutter screen 1. In any of the above, or other, embodiments, the piece of solid or perforated material can cover the entire area of step 1ST or a portion less than the entire area of step 1ST.

While many of the examples shown use a screen that has threads that extend in directions parallel and perpendicular to a longitudinal direction of the gutter guard or an edge of a gutter, other embodiments of the invention use a screen that has threads that extend in directions that are at an acute angle to a longitudinal direction of the gutter guard or an edge of a gutter. Some embodiments use a screen in which the threads are not orthogonal to one another. Some embodiments use a screen in which the threads are not orthogonal to one another and all threads are at an acute angle to a longitudinal direction of the gutter guard or an edge of a gutter. In some applications, screens with threads that are at an acute angle to a longitudinal direction of the gutter guard or an edge of a gutter pass more water through the screen than screens with similarly spaced threads that are parallel and perpendicular to the longitudinal direction of the gutter guard or an edge of a gutter.

While some of the examples shown larger or harder threads or a braid of threads grouped together in the screen, other examples space a single larger or harder thread or a braid of threads among smaller and/or softer threads. In embodiments, a single (or some other number) of larger or harder threads or a braid of threads are evenly (or unevenly) spaced among a number of smaller and/or softer threads.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention. The choice of words used for the description of an element is one of many common words that could have been chosen and thus the word is not meant to impact the intent what the element was intended to do.

What is claimed is:

1. A gutter guard for filtering water that enters a rain gutter on a building, the gutter guard comprising:

a screen body configured to be positioned above a lowest portion of the rain gutter and having a plurality of openings that are penetrable by water, the screen body having a first surface;

a second surface; and a channel positioned between the first surface and the second surface, the channel having a first wall adjacent to and extending in a first direction from the first surface, the first wall having a height in the first direction, a second wall adjacent to and extending in the first direction from the second surface, the second wall having a height in the first direction, and a joining section that joins the first wall to the second wall, wherein the height of the first wall and the height of the second wall are different, the first wall contacts the second wall for the entire height of one of the first wall or the second wall, and the screen body is a mesh.

2. The gutter guard of claim 1, wherein the first surface is planar, the second surface is planar, and the first surface and the second surface are not coplanar.

3. The gutter guard of claim 1, wherein the first wall is configured to extend in the first direction into the gutter.

4. The gutter guard of claim 1, wherein the screen body is configured such that the second surface is downstream of the first surface when installed on the gutter.

5. The gutter guard of claim 4, wherein the height of the first wall is larger than the height of the second wall.

6. The gutter guard of claim 4, wherein the height of the first wall is smaller than the height of the second wall.

7. The gutter guard of claim 6, further comprising a solid material insert adjacent the second wall, the solid material insert extending above the first surface in a direction opposite to the first direction.

8. The gutter guard of claim 1, wherein the mesh is a single layer mesh.

9. The gutter guard of claim 1, further comprising a solid material reinforcement bar located where the first wall extends from the first surface.

10. The gutter guard of claim 1, wherein the joining section is U-shaped.

11. The gutter guard of claim 1, wherein the joining section is V-shaped.

12. The gutter guard of claim 1, further comprising a third wall adjacent to and extending in the first direction from the second surface, a third surface, a fourth wall adjacent to and extending in the first direction from the third surface, and a second joining section that joins the third wall to the fourth wall.

13. The gutter guard of claim 1, wherein at least a portion of the second surface is configured to be positioned vertically between a front lip of rain gutter and the lowest portion of the rain gutter, wherein the front lip of the rain gutter is located opposite to a portion of the gutter that is configured to attach to the building.

14. A filtration screen for filtering a liquid that flows over the filtration screen from an upstream position to a downstream position, the filtration screen comprising:

a screen body having a plurality of openings that are penetrable by the liquid, the screen body having a first surface comprising at least a portion of the plurality of openings;

a second surface; and a channel positioned between the first surface and the second surface, the channel having a first wall adjacent to and extending in a first direction from the first surface, the first wall having a height in the first direction, a second wall adjacent to and extending in the first direction from the second surface, the second wall having a height in the first direction, and a joining section that joins the first wall to the second wall, wherein the height of the first wall and the height of the second wall are different, and the first wall contacts the second wall for the entire height of one of the first wall or the second wall.

15. The gutter guard of claim 14, wherein the screen body is an expanded metal.

16. The filtration screen of claim 14, wherein the second surface is downstream of the first surface, and the height of the first wall is smaller than the height of the second wall.

17. The gutter guard of claim 14, wherein second surface comprises at least a portion of the plurality of openings.

18. The gutter guard of claim 17, wherein channel comprises at least a portion of the plurality of openings.

19. A filtration screen for filtering a liquid that flows over the filtration screen from an upstream position to a downstream position, the filtration screen comprising:

a screen body having a plurality of openings that are penetrable by the liquid, the screen body having a first surface comprising at least a portion of the plurality of openings;

a second surface;

a first channel having a first wall having a height, a second wall a height, and a joining section that joins the first wall to the second wall;

a second channel having a third wall, a fourth wall, and a joining section that joins the third wall to the fourth wall, and a channel joining section that joins the second wall to the third wall, the channel joining section being one of U-shaped and V-shaped, wherein the first wall adjoins the first surface, the second wall adjoins the channel joining section, the third wall adjoins the channel joining section, the fourth wall adjoins the second surface, and the height of the first wall and the height of the second wall are different, and the first wall contacts the second wall for the entire height of one of the first wall or the second wall.

20. The filtration screen of claim 19, wherein the third wall has a height, and the height of the third wall and the height of the second wall are different.

21. The filtration screen of claim 19, wherein the first surface is upstream from the first channel, and the height of the first wall is smaller than the height of the second wall.

22. The filtration screen of claim 19, wherein the first surface is upstream from the first channel, and the height of the first wall is larger than the height of the second wall.

23. A gutter guard for filtering water that enters a rain gutter on a building, the gutter guard comprising:

a screen body configured to be positioned above a lowest portion of the rain gutter and having a plurality of openings that are penetrable by water, the screen body having a first surface;

a second surface downstream of the first surface; and a step positioned between the first surface and the second surface, the step having a wall extending in a first direction from the first surface to the second surface, the wall having a height in the first direction, the first direction being away from the lowest portion of the rain gutter, and the height being a distance between the first surface and the second surface at the wall, wherein the first surface and the second surface are non-coplanar, and the screen body is a mesh.

24. The gutter guard of claim 23, wherein the step is formed from more than one layer of the screen body.

25. The gutter guard of claim 23, further comprising a material attached to the screen body, wherein the material covers a portion of the step.

26. The gutter guard of claim 23, wherein the step is entirely in one plane, and the wall is entirely in the one plane.

* * * * *